US008844584B1

(12) United States Patent
Haley et al.

(10) Patent No.: US 8,844,584 B1
(45) Date of Patent: Sep. 30, 2014

(54) APPARATUS AND METHOD FOR A PRESSURIZED DISPENSER REFILL SYSTEM

(75) Inventors: Kevin Haley, Byron Center, MI (US); Eric J. Hansen, Ada, MI (US); Christopher D. Barr, Belmont, MI (US); Eric C. Huffman, Lowell, MI (US); Kenneth M. Lenkiewicz, Grand Rapids, MI (US); Joseph P. Perry, Comstock Park, MI (US); Justin Benacquisto, Caledonia, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 906 days.

(21) Appl. No.: 13/022,368

(22) Filed: Feb. 7, 2011

Related U.S. Application Data

(60) Provisional application No. 61/301,763, filed on Feb. 5, 2010.

(51) Int. Cl.
*B65B 31/00* (2006.01)

(52) U.S. Cl.
CPC ..... *B65B 31/003* (2013.01); *B65B 31/00* (2013.01)
USPC .. 141/20; 141/3; 53/470; 53/471; 222/402.16

(58) Field of Classification Search
CPC ..... B65B 1/003; B65D 83/425; B65D 83/62
USPC ..... 141/2, 3, 18, 20; 222/95, 105, 395, 222/402.1
See application file for complete search history.

(56) References Cited

U.S. PATENT DOCUMENTS

| | | | | | |
|---|---|---|---|---|---|
| 2,952,278 | A | * | 9/1960 | Waldherr | 141/20 |
| 3,064,696 | A | * | 11/1962 | Gruenewald | 141/20 |
| 3,126,132 | A | * | 3/1964 | Lyon | 222/355 |
| 3,319,669 | A | * | 5/1967 | Abplanalp | 141/20 |
| 3,354,916 | A | * | 11/1967 | Ruscitti | 141/20 |
| 3,438,610 | A | * | 4/1969 | Hug | 251/303 |
| 3,605,791 | A | * | 9/1971 | Troadec | 137/316 |
| 3,680,605 | A | * | 8/1972 | Nigro | 141/20 |
| 3,687,174 | A | * | 8/1972 | Palan | 141/20 |
| 3,827,608 | A | * | 8/1974 | Green | 222/402.16 |
| 3,880,207 | A | * | 4/1975 | Giuffredi | 141/20 |

(Continued)

FOREIGN PATENT DOCUMENTS

| | | | |
|---|---|---|---|
| CA | 2633240 | A1 | 4/2006 |
| DE | 9216163 | U | 8/1993 |

(Continued)

*Primary Examiner* — Timothy L Maust
(74) *Attorney, Agent, or Firm* — McGarry Bair PC

(57) ABSTRACT

A sustainable system for refilling a pressurized fluid dispenser comprises a container body having a first fluid dispenser that includes a valved opening, a pouch mounted within the container body for storing a fluid composition and fluidly coupled with the valved opening of the container for dispensing the contents of the pouch and a fluid refill system. A pressurized gas can be provided between the pouch and the container body for pressurizing the contents of the pouch. The fluid refill system includes at least one reservoir having a fluid composition therein and a second fluid dispenser having a fitting that is adapted to dispense the fluid composition from the at least one reservoir into the pouch. A controller can be programmed to respond to input signals to position the container with the fluid refill system and to dispense the fluid composition under pressure into the pouch.

24 Claims, 12 Drawing Sheets

(56) References Cited

U.S. PATENT DOCUMENTS

| | | | | | |
|---|---|---|---|---|---|
| RE28,750 | E | * | 3/1976 | Le Troadec | 264/524 |
| 4,148,416 | A | * | 4/1979 | Gunn-Smith | 222/94 |
| 4,589,452 | A | * | 5/1986 | Clanet | 141/3 |
| 4,875,508 | A | * | 10/1989 | Burke et al. | 141/2 |
| 4,911,212 | A | | 3/1990 | Burton | |
| 4,929,818 | A | | 5/1990 | Bradbury et al. | |
| 5,203,383 | A | | 4/1993 | Turunen | |
| 5,273,191 | A | * | 12/1993 | Meshberg | 222/105 |
| 5,361,942 | A | * | 11/1994 | Salkeld et al. | 222/105 |
| 5,366,115 | A | * | 11/1994 | Kersten et al. | 222/105 |
| 5,392,958 | A | * | 2/1995 | Kurtzahn et al. | 222/105 |
| 5,485,872 | A | * | 1/1996 | Kerger | 141/329 |
| 5,630,530 | A | * | 5/1997 | Geier et al. | 222/95 |
| 5,655,691 | A | * | 8/1997 | Stern et al. | 222/402.1 |
| 5,884,679 | A | * | 3/1999 | Hansen et al. | 141/386 |
| 5,971,230 | A | * | 10/1999 | Tanaka | 222/402.11 |
| 6,073,804 | A | * | 6/2000 | Yquel | 222/95 |
| 6,116,296 | A | | 9/2000 | Turunen | |
| 6,155,457 | A | * | 12/2000 | Landa et al. | 222/94 |
| 6,578,763 | B1 | | 6/2003 | Brown | |
| 6,595,246 | B2 | * | 7/2003 | Brozell et al. | 141/18 |
| 6,615,880 | B2 | | 9/2003 | Hewlitt et al. | |
| 6,651,847 | B2 | * | 11/2003 | Mekata et al. | 222/105 |
| 6,705,358 | B1 | | 3/2004 | Tortorici, Jr. et al. | |
| 6,772,944 | B2 | | 8/2004 | Brown | |
| 6,789,702 | B2 | * | 9/2004 | O'Connor et al. | 222/96 |
| 6,874,544 | B2 | * | 4/2005 | O'Connor et al. | 141/3 |
| 7,065,940 | B2 | | 6/2006 | Dudek et al. | |
| 7,066,215 | B1 | | 6/2006 | Hewlitt et al. | |
| 7,083,093 | B1 | | 8/2006 | Brown | |
| H002205 | H | * | 11/2007 | Andersen et al. | 141/20 |
| 7,343,943 | B2 | * | 3/2008 | Khan et al. | 141/95 |
| 7,448,517 | B2 | * | 11/2008 | Shieh et al. | 222/394 |
| 7,470,293 | B2 | * | 12/2008 | Edlund et al. | 48/61 |
| 7,523,767 | B2 | * | 4/2009 | Pericard | 141/10 |
| 7,588,170 | B2 | * | 9/2009 | van der Heijden | 222/137 |
| 7,828,173 | B2 | * | 11/2010 | Geier et al. | 222/105 |
| 8,052,014 | B2 | * | 11/2011 | Hasegawa et al. | 222/400.7 |
| 8,096,327 | B2 | * | 1/2012 | Hirz | 141/20 |
| 8,328,047 | B2 | * | 12/2012 | Walters et al. | 222/95 |
| 8,448,677 | B2 | * | 5/2013 | Ficai et al. | 141/113 |
| 8,459,311 | B2 | * | 6/2013 | Green | 141/3 |
| 8,479,779 | B2 | * | 7/2013 | Behar | 141/3 |
| 2003/0051767 | A1 | | 3/2003 | Coccaro et al. | |
| 2004/0020723 | A1 | | 2/2004 | Schuman et al. | |
| 2004/0216802 | A1 | * | 11/2004 | O'Connor et al. | 141/1 |
| 2006/0261156 | A1 | | 11/2006 | Brown | |
| 2007/0175537 | A1 | * | 8/2007 | Farina | 141/20 |
| 2009/0236363 | A1 | * | 9/2009 | Haley et al. | 222/95 |
| 2010/0264165 | A1 | * | 10/2010 | Hansen et al. | 222/95 |
| 2011/0017770 | A1 | * | 1/2011 | Maas et al. | 222/1 |
| 2012/0024419 | A1 | * | 2/2012 | Behar | 141/1 |
| 2012/0168027 | A1 | * | 7/2012 | Hosoda et al. | 141/20 |

FOREIGN PATENT DOCUMENTS

| | | |
|---|---|---|
| EP | 0535478 B | 9/1992 |
| EP | 0640556 | 8/1994 |
| WO | 2004074165 A1 | 9/2004 |

* cited by examiner

APPARATUS AND METHOD FOR A PRESSURIZED DISPENSER REFILL SYSTEM

CROSS REFERENCE TO RELATED APPLICATIONS

This application claims the benefit of U.S. Provisional Patent Application No. 61/301,763, filed Feb. 5, 2010, which is incorporated herein by reference in its entirety.

BACKGROUND OF THE INVENTION

This invention relates to a packaged pressurized dispenser and a sustainable system and method for refilling the pressurized dispenser.

U.S. Pat. No. 7,065,940 to Dudek et al., U.S. Pat. No. 6,578,763 to Brown, U.S. Pat. No. 6,615,880 to Hewlett et al., U.S. Patent Application No. 2004/020723 to Schuman et al., U.S. Patent Application No. 2003/051767 to Coccaro et al., European Patent Publication 0640556 to Thurn, and German Patent No. 921613 to Spohn disclose a system for consumer refilling of unpressurized containers in a retail setting with a cleaning product from a bulk dispenser.

U.S. Pat. No. 4,911,212 to Burton discloses a bottle filling machine in which a probe extends into the chamber and engages an opening in the refillable bottle to fill and pressurize the bottle. After filling, the probe retracts for removal of the filled bottle from the chamber.

U.S. Pat. No. 4,938,260 to Hirz discloses an apparatus for filling a pressurized can comprising an aerosol propellant with paint or other liquid.

U.S. Pat. No. 5,179,982 to Bérubé et al. discloses a dispensing package having a container and a plastic bag mounted to a lip of the container. The container has a valve at a bottom end thereof for admitting compressed air into the container between a sidewall of the container and the plastic bag for pressurizing the contents of the plastic bag. The plastic bag can be refilled when empty and the container can be re-pressurized through the valve at the bottom of the container.

U.S. Pat. Nos. 6,116,296 and 5,203,383 to Turunen disclose an apparatus for refilling an aerosol package having an outer pressure resistant shell and a resilient container disposed within the shell. A propellant gas is located in the space between the shell and the resilient container.

SUMMARY

According to one embodiment, a sustainable system for refilling a pressurized fluid dispenser comprises a container body having a first fluid dispenser that includes a valved opening, a pouch mounted within the container body for storing a fluid composition therein and fluidly coupled with the valved opening for dispensing the contents of the pouch and a fluid refill system. A dispensing tube extends from the valved opening to a dispensing outlet, the dispensing tube further comprising an extension that branches from the dispensing tube and a check valve to preclude fluid flow from the dispensing tube into the extension. A pressurized gas can be provided between the pouch and the container body for pressurizing the contents of the pouch for dispensing under pressure through the first fluid dispenser. The fluid refill system includes at least one reservoir having a fluid composition therein and a second fluid dispenser connected to the at least one reservoir and having a fitting that is adapted to interface with the valved opening of the first fluid dispenser to dispense the fluid composition under pressure into the pouch. A controller can be programmed to respond to input signals to position the container body into a docking relationship with the fluid refill system wherein the second fluid dispenser fitting interfaces with the first fluid dispenser, and to dispense the fluid composition under pressure into the pouch. The extension can include a fitting adapted to interface with the second fluid dispenser fitting for filling the pouch.

According to another embodiment, the space between the container body and the pouch is provided with at least one of a neutralizing additive and a deactivating additive. The neutralizing additive can be metasilicate pentahydrate. The deactivating additive can be adapted to deactivate an enzyme and/or an oxidizing agent.

According to yet another embodiment, the first fluid dispenser includes a valve body that forms the valved opening and the pouch is sealed on the valve body. The valve body can have a plurality of raised features to increase the surface area of a sealing interface between the valve body and the pouch. The system can further comprise a support between the container body and the pouch to support at least a portion of the weight of the pouch within the container body. The support can comprise a clip, a clamp, a hook, a netting, a pedestal, a piston or combinations thereof.

According to another embodiment, a sustainable system for refilling a pressurized fluid dispenser comprises a container body having a first fluid dispenser that includes a valved opening having a normally closed valve, a pouch mounted within the container body for storing a fluid composition therein and fluidly coupled with the valved opening for dispensing the contents of the pouch and a fluid refill system. A dispensing tube extends from the valved opening to a dispensing outlet, the dispensing tube further comprising an extension that branches from the dispensing tube and a bistable flap that is moveable between a first position in which the flap blocks the fluid flow through the extension and a second position in which the flap blocks the flow of fluid to the dispensing outlet. A pressurized gas can be provided between the pouch and the container body for pressurizing the contents of the pouch for dispensing under pressure through the first fluid dispenser. The fluid refill system includes at least one reservoir having a fluid composition therein and a second fluid dispenser connected to the at least one reservoir and having a fitting that is adapted to interface with the valved opening of the first fluid dispenser to dispense the fluid composition under pressure into the pouch. A controller can be programmed to respond to input signals to position the container body into a docking relationship with the fluid refill system wherein the second fluid dispenser fitting interfaces with the first fluid dispenser, and to dispense the fluid composition under pressure into the pouch. The extension can include a fitting adapted to interface with the second fluid dispenser fitting for filling the pouch.

According to another embodiment, a sustainable system for refilling a pressurized fluid dispenser comprises a container body having a first fluid dispenser that includes a valved opening having a normally closed valve, a pouch mounted within the container body for storing a fluid composition therein and fluidly coupled with the valved opening for dispensing the contents of the pouch and a fluid refill system. A dispensing tube extends from the valved opening to a dispensing outlet. A pressurized gas can be provided between the pouch and the container body for pressurizing the contents of the pouch for dispensing under pressure through the first fluid dispenser. The fluid refill system includes at least one reservoir having a fluid composition therein and a second fluid dispenser connected to the at least one reservoir and having a fitting that is adapted to interface with the valved opening of the first fluid dispenser to dispense the fluid composition under pressure into the pouch. A controller can be programmed to respond to input signals to position the container body into a docking relationship with the fluid refill system wherein the second fluid dispenser fitting interfaces with the first fluid dispenser, and to dispense the fluid composition under pressure into the pouch. The first fluid dispenser further includes a selectively rotatable cap that is rotatable between a first position in which the dispensing outlet is accessible and a second position in which a filling inlet is accessible and wherein when the cap is in the first position the fluid composition can be selectively dispensed from the pouch through the dispensing outlet onto a surface to be cleaned and when the cap is in the second position the pouch can be refilled through the filling inlet by the refill system.

DESCRIPTION OF AN EMBODIMENT OF THE INVENTION

Pressurized Dispenser

A pressurized fluid dispenser 10 suitable for use according to the invention can be a pouch-on-valve type of dispenser such as is disclosed in U.S. Patent Publication No. 2009/0236363 to Haley et al. and U.S. Patent Publication No. 2009/0108021 to Hansen et al., which are incorporated herein by reference in their entirety.

Figure 1:
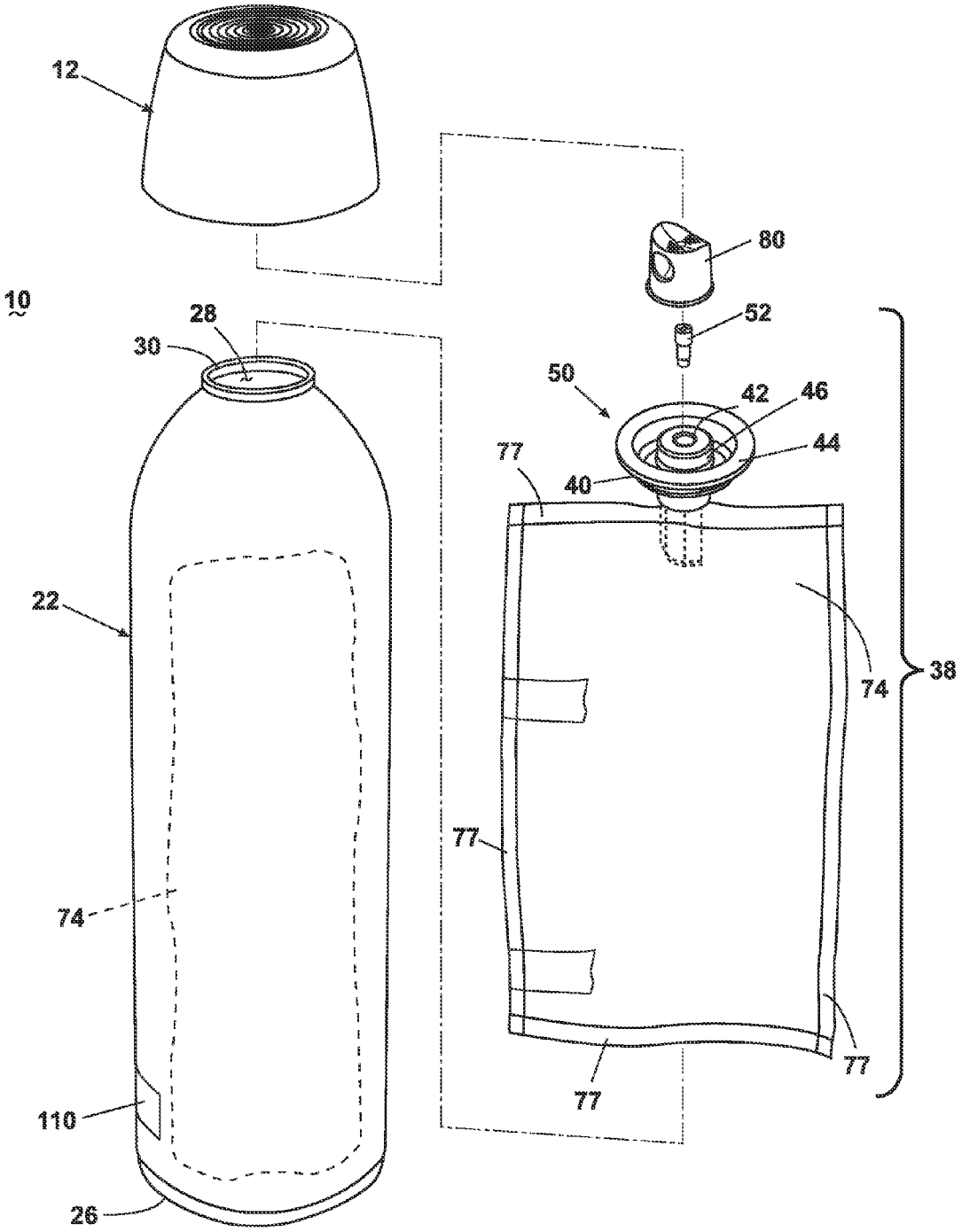
FIG. 1 is an exploded view of a pressurized dispenser according to a first embodiment of the invention.
Figure 2:
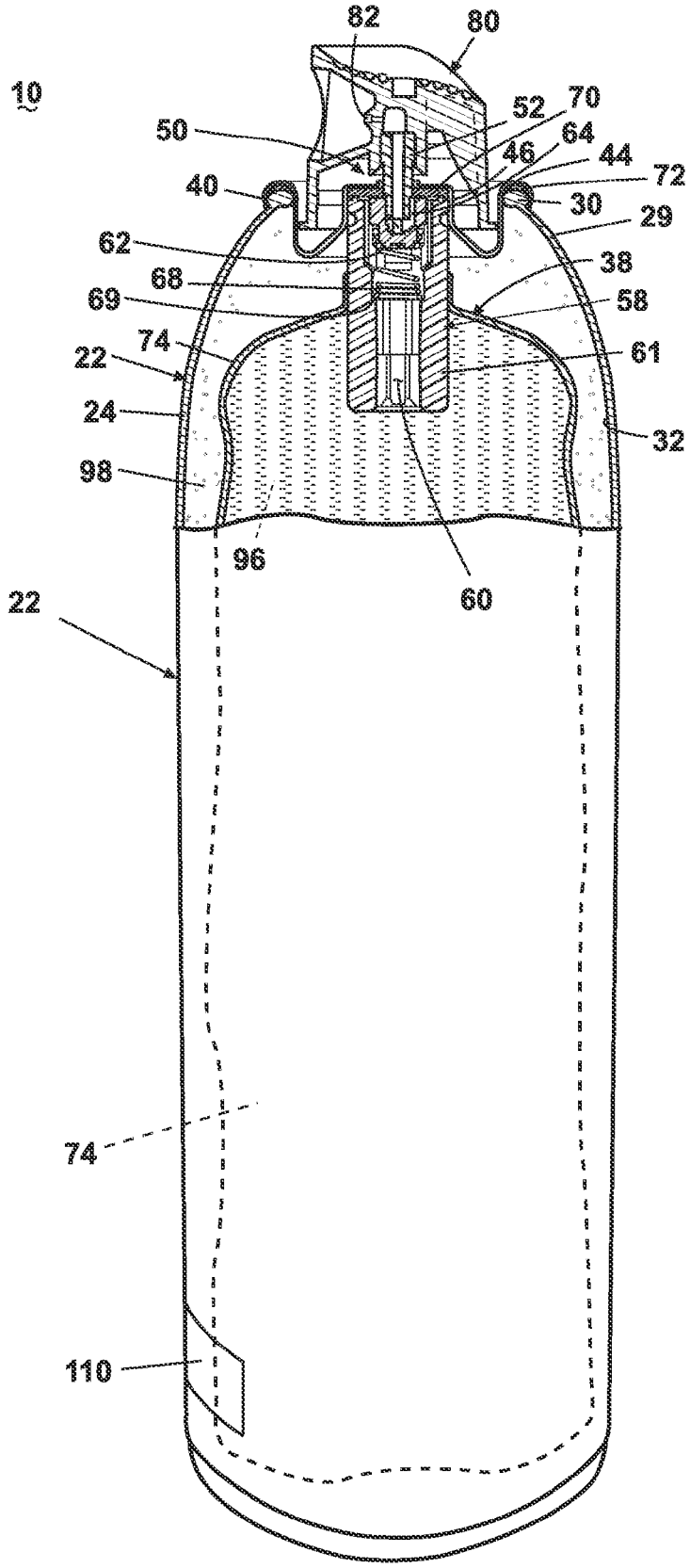
FIG. 2 is a cross-section of the assembled pressurized dispenser of FIG. 1.

Referring now to FIGS. 1 and 2, a pressurized fluid dispenser 10 can comprise a container 22, a pouch-on-valve assembly 38 for storing a cleaning composition and regulating its dispensing, an actuator 80 operably coupled to the pouch-on-valve assembly 38 for selectively dispensing the cleaning composition onto the surface to be cleaned, and a removable cap 12 that is selectively placed on the container 22 to cover the actuator 80. The pouch-on-valve assembly 38 can comprise a pouch 74 received within the container 22 for storing a supply of cleaning composition and a valve assembly 50 that is hermetically sealed to the pouch 74 and on which the actuator 80 is mounted. The valve assembly 38 can further comprise a valve mounting cup 40 that mounts the pouch-on-valve assembly 38 to the container 22.

The container 22 can have any desirable shape or be made from any desired material, such as plastic or metal that meets general industry pressure safety guidelines (e.g. 100 psi). For example, the container 22 can be made from aluminum or steel. In another example, the container 22 can be made from an injection molded or blow molded thermoplastic; however, other commonly known plastic forming methods can also be used to form the container 22. The container 22 can have any shape and/or be of any color. When the container 22 is made from plastic, it can be provided with a unique, consumer-identifiable shape and/or color. The container 22 can also be formed in a shape that is not associated with a traditional aerosol-type dispenser. For example, the container 22 can be made from plastic and provided with a shape that appears similar to traditional non-pressurized, trigger-spray type dispensers. This can be useful when attempting to overcome consumer bias towards products that look like aerosols, which may have developed as a result of a consumer's previous experience with traditional aerosol products and/or the negative portrayal of traditional aerosols in the media and by some environmental groups. In addition, while the container 22 is illustrated as having a push button actuator 80, the actuator 80 can have any shape or form. For example, the actuator 80 can be in the form of a trigger.

Referring now to FIG. 2, a cleaning composition 96 can be delivered to the surface to be cleaned from the pouch 74 via the actuator 80, which is in fluid communication with the push valve assembly 50 that is sealed to the flexible pouch 74. Positive pressure inside the container 22 is generated by a pressurized gas 98 that is injected during the container filling process into the space between an inner surface 32 of the container 22 and the pouch 74. The pressurized gas 98 is filled to a level sufficient for generating the required force to deliver the cleaning composition 96 to the surface to be cleaned with spray characteristics, i.e. the force of the spray, the diameter of the spray, the type of particle sprayed, that is desirable for the intended application. Examples of suitable pressurized gases are nitrogen and compressed air due to their inert nature and low-impact on the environment compared to traditional propellants that are composed of volatile organic compounds (VOCs). However, traditional propellants such as n-butane, isobutene, propane, or combinations thereof, can also be used, for example.

The valve mounting cup 40 is mounted within the open end 28 of the container 22 to mount the pouch-on-valve assembly 38 within the container 22 and to close the open end 28. The valve mounting cup 40 comprises a central cylindrical protrusion 46 having a dispensing opening 42 therein and an annular lip 44 formed on the periphery of the valve mounting cup 40. The annular lip 44 is sized to receive and seal the open end 28 of the container 22. The annular lip 44 further includes a gasket 72 to insure a leak proof seal to the bead 30 formed on the container 22. The valve mounting cup 40 can be manufactured of a tin steel material. The gasket 72 can be comprised of a butyl rubber material. Alternatively, the valve cup 40 can be laminated with a polymer material, which can form a seal with the container 22, negating the need for a separate gasket.

The valve assembly 50 further comprises a valve housing 58 that receives a hollow valve stem 52 having a solid plunger 62 mounted to a lower end thereof. The valve housing 58, which is preferably injection molded polypropylene material, comprises a fluid flow channel 60 formed therethough that is in fluid communication with the cleaning composition 96 within the pouch 74.

The plunger 62 is biased by a compression spring 68 to the closed position of the valve assembly shown in FIG. 2. The compression spring 68, which can be comprised of INOX AISI 302 stainless steel material, is positioned between a support rib 69 formed within the valve housing 58 and the solid plunger 62. A gasket 70 is located between the valve housing 58 and the valve mounting cup 40 and forms a valve seat for the plunger 62. The gasket 70 can be a butyl rubber. Alternative suitable gasket materials can include: buna-nitrile (buna-n), rubber, Viton, or ethylene propylene diene monomer rubber (EPDM).

The pouch 74 can comprise multiple layers of flexible material that are laminated together. All of the layers of the pouch can be hermetically sealed to a valve body 61 of the valve housing 58. The outer edges of the layers can be sealed by a heat seal bonding process that uses heat and pressure to permanently bond the edges of the layers to form a hermetically sealed edge 77 on the pouch 74. The pouch 74 can subsequently be sealed to the valve housing 58 by a heat seal bonding process that uses heat and pressure to permanently bond the pouch 74 to the valve housing 58.

The type, number and order of the layers of the pouch can be selected based on the specific cleaning composition stored within the pouch 74 to provide a pouch 74 that does not interact with or result in the degradation of the components of the cleaning composition and to provide a pouch 74 that can withstand multiple fillings. For example, one or more layers 76 can be modified to provide a pouch 74 that is flexible and durable enough to withstand multiple fillings without cracking or wearing of the pouch 74. Non-limiting examples of materials that can be incorporated into one or more layers of the pouch 74 include metals, such as aluminum and tin, and polymers such as low density polyethylene (LDPE), linear low density polyethylene (LLDPE), high density polyethylene (HDPE), polypropylene (PP), polyethylene terephthalate (PET), polyamide (nylon), single site metallocene polymer (SSC), ionomer, polyvinylidene chloride (PVDC), ethylene acrylic acid (EAA), ethylene vinyl acetate (EVA), polyvinyl alcohol (PVOH), ethylene vinyl alcohol (EVOH), polyethylene napthalate (PEN) and thermoplastic elastomers (TPE). In addition, a surface treatment can be applied to an innermost layer of the pouch 74 to provide improved chemical impermeability.

The pouch 74 can be coupled with the valve body 61 in any suitable manner to hermetically seal the pouch 74 and the valve body 61. Preferably, the pouch 74 is sealed to the valve body 61 in such a manner that the seal is maintained during the filling of the pouch 74 with a cleaning composition and also during a subsequent refilling process. As described above, the layers of the pouch 74 can be sealed by a heat seal bonding process to the valve body 61. Alternatively, an ultrasonic welding process can be used. In another example, the valve body 61 can be provided with a plurality of raised features, such as ridges of protrusions, to increase the surface area of the sealing surface on the valve body 61. The increased surface area of the sealing surface can result in a more robust seal that can withstand multiple filling processes.

In yet another example, the pouch 74 can first be sealed to a threaded element or coupling in a manner that provides a seal that can withstand multiple filling processes, such as an ultrasonic weld or an with an adhesive. The threaded element can then be coupled with mating threads provided on the valve body 61 for sealing the pouch 74 to the valve body 61.

The dispenser 10 can be used to store and dispense any suitable composition, non-limiting examples of which are disclosed in U.S. Patent Publication No. 2009/0108021 to Hansen et al., U.S. Provisional Application No. 61/169,525 to Hansen et al., U.S. Patent Publication No. 2009/0236363 to Haley et al., U.S. Pat. No. 5,948,480 to Murphy, U.S. Pat. No. 6,043,209 to Micciche et al., U.S. Pat. No. 5,534,167 to Billman, U.S. Pat. No. 5,888,290 to Engle et al. and U.S. Publication No. 2003/0075203 to Hansen et al. which are incorporated by reference in their entirety. In another example, the dispenser 10 can be used to store an acaricidal composition such as Acarosan® (available from BISSELL Inc., Michigan). The materials used to form the pouch 74 can be selected based on the composition stored within the pouch 74, as discussed above.

In use, the cleaning composition 96 can be dispensed onto a target surface to be cleaned by depressing the actuator 80 and subsequently creating a fluid flow path between the pouch 74 and the terminal spray orifice 82. Depression of the actuator 80 forces the plunger 62 downward, compressing the spring 68 and breaking the seal between the gasket 70 and the plunger 62, thereby opening up the fluid channel 60 for fluid to flow to the valve stem 52 through fluid flow orifices 64. The compressed propellant gas 98 introduces a positive pressure inside the container 22 and compresses the pouch 74, thereby forcing the cleaning composition 96 out of the pressurized container 22 through the terminal spray orifice 82. When downward pressure on the actuator 80 is released, the spring 68 forces the plunger 62 and the valve stem 52 upward. The plunger 62 seals against the gasket 70 and ceases the flow of the cleaning composition 96 out of the pouch 74.

Figure 12C:
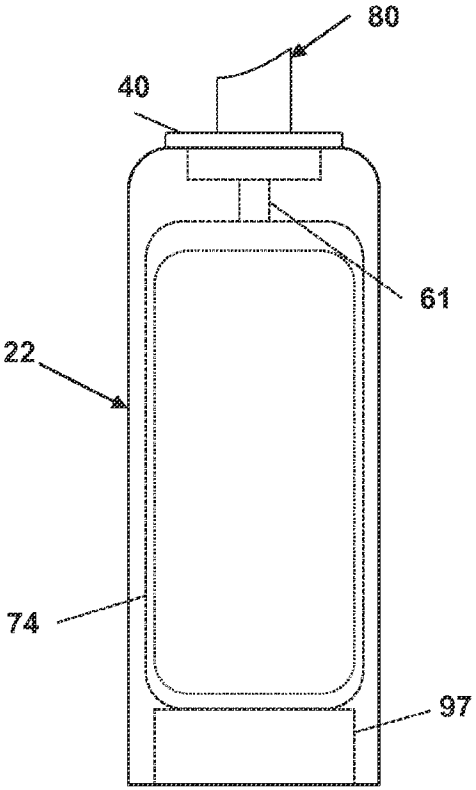
FIGS. 12A through 12C are a side elevational view of a pressurized dispenser according to an eleventh through thirteenth embodiment of the invention, respectively.
Figure 12B:
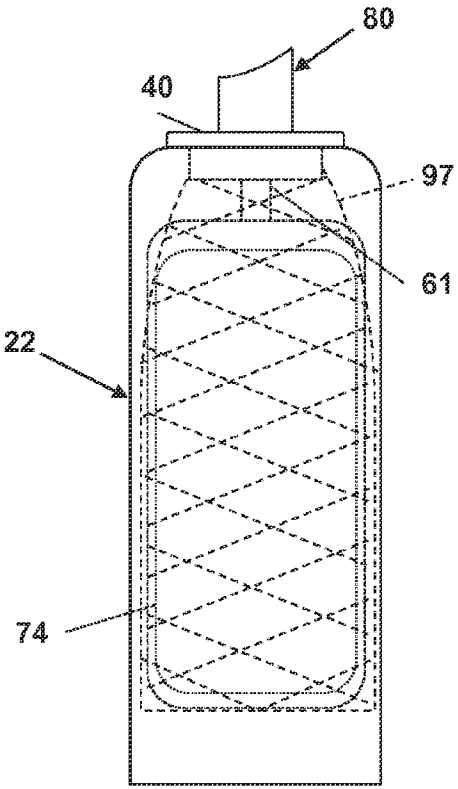
Figure 12A:
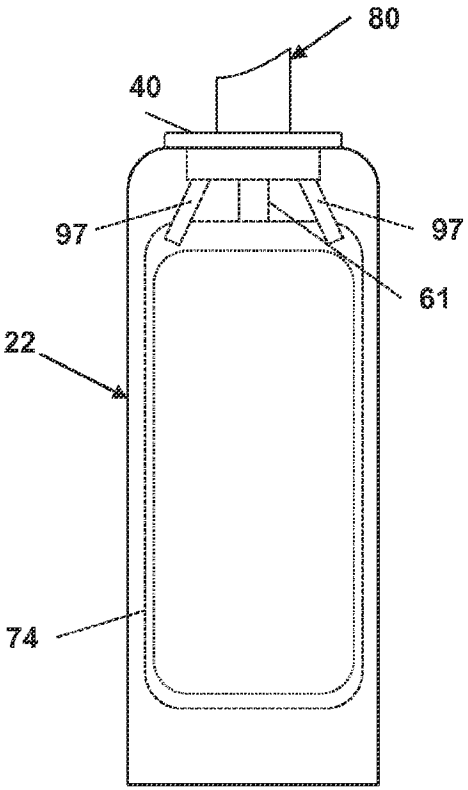

Referring now to FIGS. 12A though 12C, the dispenser 10 can also be provided with one or more support elements 97 to support the weight of the pouch 74 within the container 22, such that the entire weight of the pouch 74 is supported by more than just the seal to the valve body 61. For example, as illustrated in FIG. 12A, the pouch 74 can be coupled with a support element 97 in the form of a mechanical fastener, such as a clip, clamp or hook, extending from an inner surface of the valve mounting cup 40. FIG. 12B illustrates another example in which the pouch 74 is supported by a support element 97 in the form of a netting extending from the valve mounting cup 40. Alternatively, the mechanical fastener or netting can extend from an inner surface of the container 22. In another example, the support element 97 can be a pedestal which can be placed in a bottom portion of the container 22, such that a bottom portion of the pouch 74 can rest on the support element 97. The support element 97 can ease the stress on the seal between the pouch 74 and the valve body 61 when the pouch 74 is suspended from the valve body 61.

In yet another example, the bottom portion of the pouch 74 can rest on an upper surface of a piston provided in the bottom of the container 22. The piston can support the weight of the pouch 74 and also provide constant pressure to the pouch 74 such that the contents of the pouch 74 can be dispensed at an even pressure. The piston can be pressurized with a hydrocarbon propellant at a sufficient pressure so that as the contents of the pouch 74 are dispensed, the hydrocarbon propellant applies pressure to the piston to press against the pouch 74. In this manner, the pressure on the pouch 74 stays constant throughout the dispensing of the cleaning composition. When the pouch 74 is refilled with a cleaning composition, the pressure of the pouch 74 on the piston drives the piston back to its starting position.

The pouch 74 can also be in the form of a semi-rigid, collapsible container. One example of a suitable type of collapsible container is the Cubitainer® from Hedwin (Baltimore, Md.) made from low density polyethylene (LDPE). The collapsible container can be provided with a threaded neck that can be coupled with mating threads provided on the valve body 61 for sealing the collapsible container to the valve body 61. In addition, the collapsible container can be designed to collapse in a predetermined manner during dispensing by varying the strength of different portions of the collapsible container. The collapsible container can also be provided with a convex bottom and rest on a concave bottom of a container 22 to provide support to the bottom of the collapsible container.

The container 22 can also be provided with one or more safety features to release pressure from the container 22 in the event that the container 22 becomes over-pressurized. For example, a bottom of the container 22 can be provided with a conventional pressure relief valve. In another example, the bottom of the container 22 can be concave in shape and configured to invert in the case of an increase in pressure, as is known in the art.

The container 22 can also be provided with machine readable indicia 110 contents and dispenser information that can be read by an appropriate reading device. The indicia 110 can be in any form, non-limiting examples of which include optically readable formats, such as barcodes, a magnetic chip or a radio frequency identification (RFID) chip. The indicia 110 can include information related to the type of product suitable for use with the dispenser 10, authentication information and dispenser characteristics (e.g. fill weight, empty weight, height, fill volume). If the indicia 110 is in a read/write format, such as an RFID chip, for example, the indicia 110 can include information that can be read from the indicia 110 and then updated and re-written back to the indicia 110, such as the number of times the dispenser 10 has been filled. The indicia 110 can also include information regarding limits on the number of times the dispenser 10 can be filled. The indicia 110 can also contain information relating to the compatibility of a cleaning composition with the pouch 74 and/or the previous contents of the pouch 74. The indicia 110 can be located in any suitable position on the container 22 such that it can be read by an appropriate reading device.

The dispenser 10 can also be provided with a mechanical foaming device to generate foam as the cleaning composition 96 is being dispensed. The mechanical foaming device can introduce air into the liquid stream as it is being dispensed to generate a foam, as is known in the art. Alternatively, rather than using a mechanical foaming device, the cleaning composition 96 can be a self-foaming composition that can generate a foam when heat and/or agitation are applied to the dispensed composition. For example, the cleaning composition 96 can include isopentane, which generates foam as it escapes from solution. The generation of foam can provide the user with visual feedback during the cleaning process.

The container 22 can also include a neutralizing or deactivating additive in the space between the container 22 and the pouch 74, mixed in with the pressurizing gas 98. One or more neutralizing or deactivating additives can be provided in the container 22 based on the components in the cleaning composition 96 to neutralize or deactivate one or more components in the cleaning composition 96 that may interact with the container 22 if the cleaning composition 96 leaks from the pouch 74. For example, if a cleaning composition containing an acidic solution leaks from the pouch 74, one or more components of the acidic solution may interact with the container 22, potentially causing corrosion of the container 22 if the container 22 is made from steel or other metal. The space between the container 22 and the pouch 74 can be provided with a neutralizing additive, such as sodium metasilicate pentahydrate, for example, that can neutralize the leaked acidic solution and prevent corrosion of the container 22. In another example, the neutralizing or deactivating additive can be adapted to deactivate a cleaning composition 96 containing enzymes and/or an oxidizing agent such as hydrogen peroxide. For the purposes of this application, the terms neutralize and deactivate are used to mean that at least one component of the cleaning composition is at least partially acted upon so that interaction of the at least one component with the container 22 is at least partially inhibited.

During the course of multiple fillings of the pouch 74, the pouch 74 can experience stress and/or strain which could potentially result in rupturing of the pouch 74 and leakage of the cleaning composition 96 from the pouch 74. The neutralizing additive can be provided as an additional safety feature to limit interaction between the cleaning composition 96 and the container 22 in the event of a leakage.

Refill System

A refill system 200 can be used for refilling the pouch 74 after the contents have been dispensed. Because the pressurized gas 98 is stored separately from the cleaning composition 96 inside the pouch 74, only the cleaning composition 96 is dispensed when the actuator 80 is pressed; the pressurized gas 98 remains within the container 22. The pouch 74 can be refilled and the contents of the pouch 74 can be dispensed under pressure because the pressurized gas 98 remains within the container 22 when the cleaning composition 96 is dispensed. An example of a suitable system for refilling the pouch 74 with a cleaning composition is disclosed in U.S. Pat. No. 4,938,260 to Hirz, which is hereby incorporated by reference in its entirety.

Figure 3:
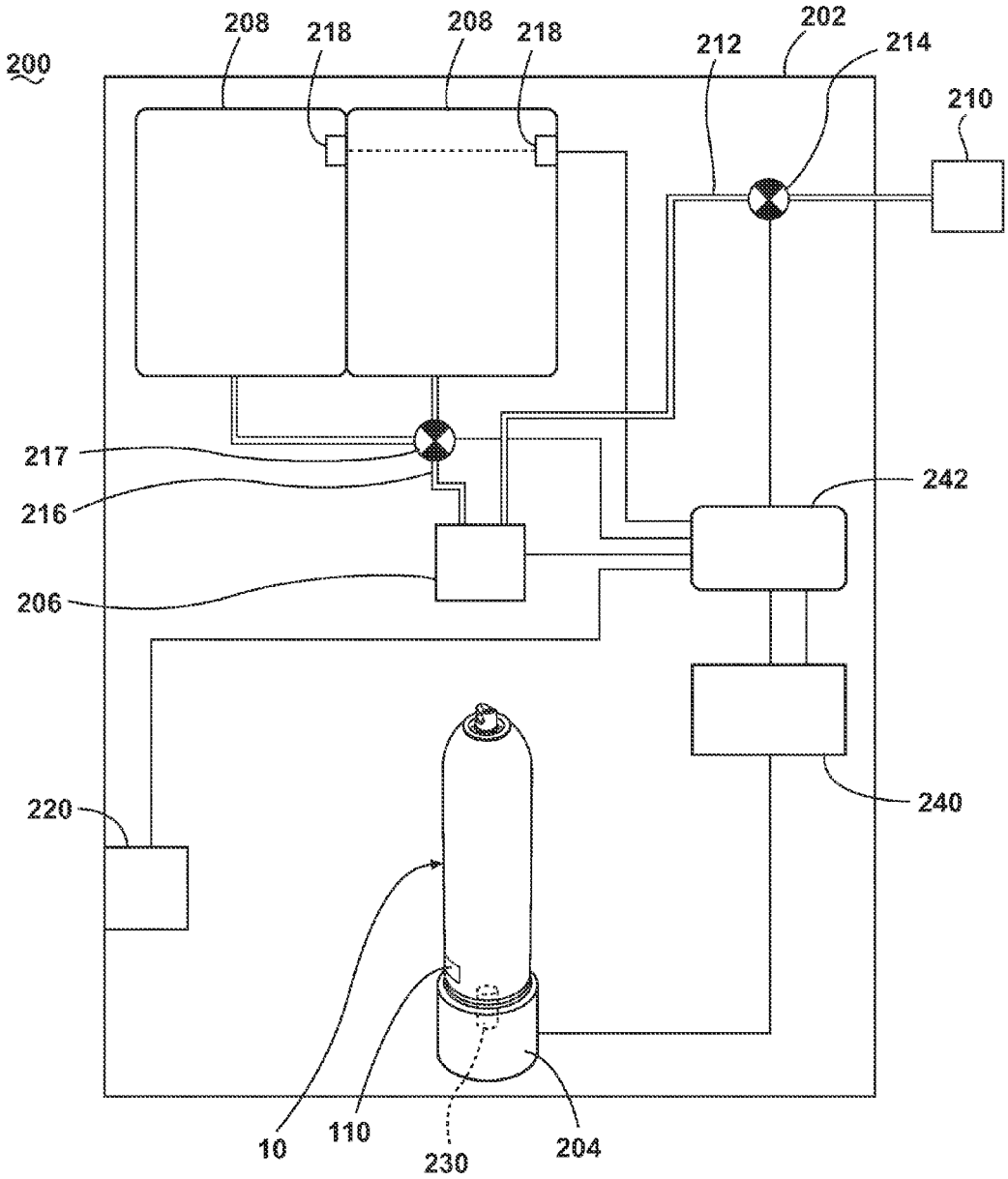
FIG. 3 is schematic view of a refill system for filling a pressurized dispenser according to a second embodiment of the invention.

Referring now to FIG. 3, the refill system 200 can comprise a housing 202 having a container support surface 204. A dispensing system 206 can be located within the housing 202 and can be fluidly coupled with one or more reservoirs 208 and, optionally, a water supply source 210. The water supply source 210 will typically be a local source of water, such as a water tap. Alternatively, the water supply source 210 can be in the form of a reservoir located within the housing 202 or external to the housing 202. The water can be distilled water or filtered water, such as water filtered by a reverse osmosis filtering system. The water supply source 210 can be fluidly coupled with the dispensing system 206 through a water supply conduit 212 having a valve 214 for controlling the flow of water through the water supply conduit 212.

The reservoirs 208 are fluidly coupled with the dispensing system 206 through a reservoir supply conduit 216. The reservoir supply conduit 216 can be provided with a mixing valve 217 for controlling the flow of liquid from the reservoirs 208 to the dispensing system 206. While the reservoir supply conduit 216 is illustrated as having one valve, it is within the scope of the invention for there to be multiple valves, each individually controlling the flow of liquid from one or more reservoirs 208.

The refill system 200 can have multiple reservoirs 208 that can be located within the housing 202 as illustrated, or at some location external to the housing 202. The multiple reservoirs 208 can be coupled with the dispensing system 206 through a single reservoir conduit 216 controlled by a single mixing valve 217 or multiple valves, as described above. Alternatively, each reservoir can be coupled with the dispensing system 206 through an individual conduit, each controlled by a valve. It is also within the scope of the invention for there to be a single reservoir coupled with the dispensing system 206 through a single reservoir conduit 216. The reservoirs 208 can also comprise one or more sensors 218 for determining the amount of material, the concentration and or the type of material in each reservoir 208.

The dispensing system 206 can comprise a pneumatic pump assembly such as that disclosed in U.S. Pat. No. 4,938,260 to Hirz that uses a pneumatically operated piston to fill an aerosol can with paint from a reservoir. The container support surface 204 can include a motor, pneumatic lift system or other device to raise and lower the container support surface 204 relative to the dispensing system 206. For example, the container support surface 204 can be selectively raised and lowered by a pneumatic cylinder, such as that disclosed in U.S. Pat. No. 4,938,260 to Hirz.

The refill system can also comprise an information sensor 220 for reading the machine readable indicia 110 located on the container 22 to determine information related to the dispenser 10. The information sensor 220 can read information related to the compatibility of the dispenser 10 with the refill system 200, the type, concentration and amount of composition that can be filled into the dispenser 10 and the number of times the dispenser 10 has been filled, for example. The information sensor 220 can be any suitable type of sensor known in the art.

For example, the information sensor 220 can be an optical sensor capable of reading machine readable indicia such as a barcode, a magnetic sensor capable of reading a magnetic chip or a radio frequency identification (RFID) scanner for reading an RFID chip. The RFID chip can be modifiable such that information can be read from the chip and written onto the chip by the information sensor 220, such as the number of times the dispenser 10 has been filled. The information sensor 220 can be located anywhere within the housing 202 such that it can read and/or receive data from the machine readable indicia 110 on the container 22, such as a housing wall or the container support surface 204.

The container support surface 204 can also include one or more container sensors 230 to detect the presence and/or weight of the dispenser 10 or the occurrence of a container 22 integrity failure. For example, the container sensor 230 can be a pressure sensor that can detect the presence and/or weight of the dispenser 10 based on the pressure exerted on the container support surface 204. In the event that the container 22 becomes over-pressurized, one or more of the safety features, such as the pop-out vents or the concave container bottom can respond to decrease the pressure within the container 22, which can result in increased pressure on the container support surface 204 that can be detected by the container sensor 230.

The refill system 200 can also comprise a user interface 240 operably coupled with a controller 242. The user interface 240 can also be connected with the internet to receive input and send output. The user interface 240 can comprise any combination of buttons, levers switches, touch pads and/or touch screens for receiving input from a user and communicating information with the user.

The controller 242 can be operably coupled with one or more components of the refill system 200 such as the dispensing system 206, the reservoir sensors 218, the information sensor 220, valves 214 and 217 and the container sensor 230. For example, the controller 242 can be coupled with the information sensor 220 to determine the amount of solution to dispense into the pouch 74 and the dispensing system 206 and mixing valve 217 to control the amount of solution dispensed into the pouch 74 based on information obtained from the information sensor 220. The controller 242 can be any type of suitable controller for controlling the operation of the refill system 200. For example, the controller 242 can have a memory for storing control software that can be executed by a central processing unit (CPU) for controlling the refill station 200 to dispense a chemistry into a dispenser 10. Other non-limiting examples include a proportional controller, a proportional-integral controller and a proportional-integral-derivative controller, as is known in the art.

Method

The previously described dispenser 10 and refill station 200 can be used to implement one or more embodiments of a method of the invention to refill the dispenser 10 after the previous contents of the dispenser 10 have been dispensed. The sequence of steps depicted is for illustrative purposes only, and is not meant to limit the embodiments of the method in any way as it is understood that the steps may proceed in a different logical order or additional or intervening steps may be included without detracting from the invention.

Figure 4:
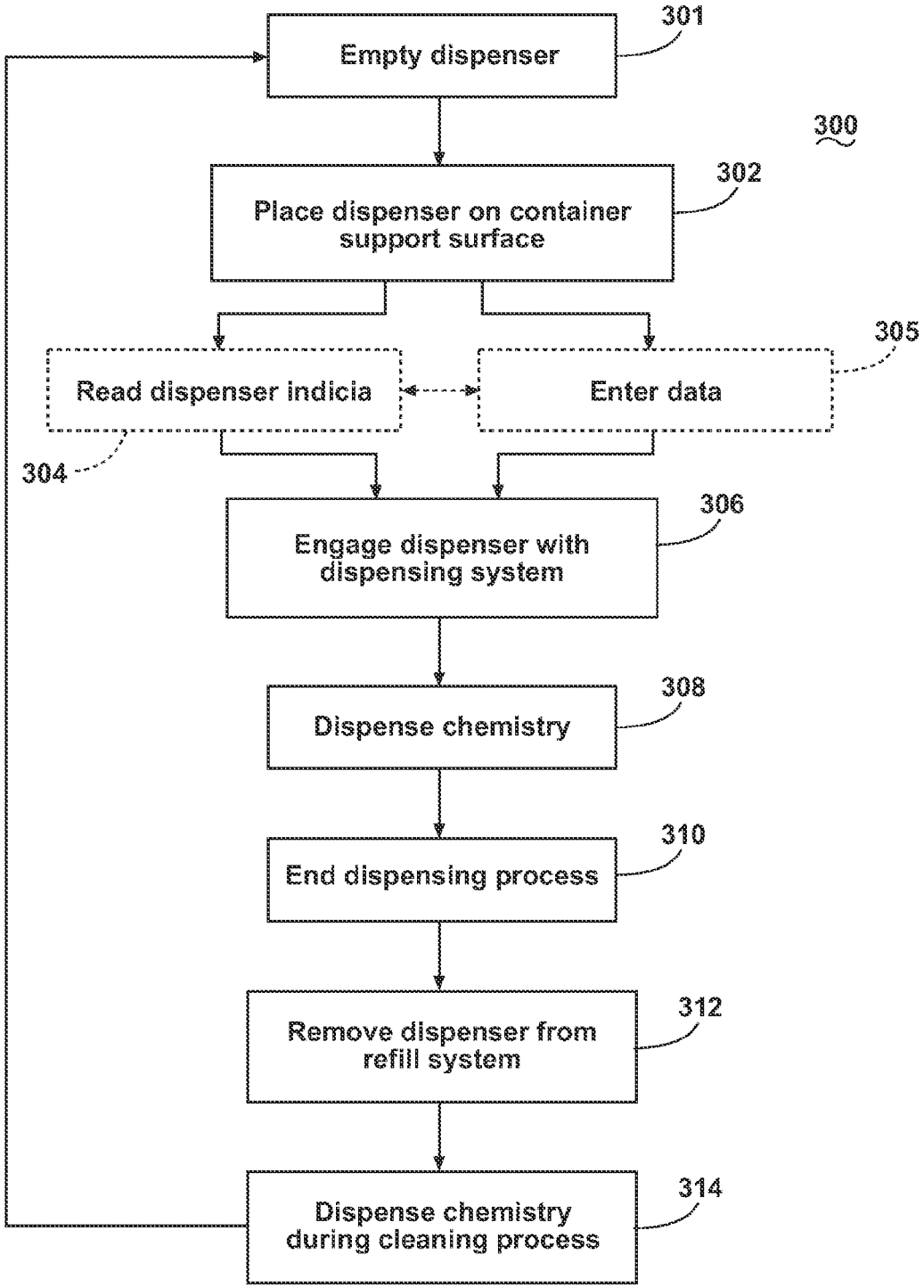
FIG. 4 is a flow chart of a method refilling a pressurized dispenser according to a third embodiment of the invention.

FIG. 4 illustrates a method 300 for refilling the dispenser 10. The method 300 begins at step 301 with an empty dispenser 10 that a user has previously purchased and dispensed the material from during a cleaning process. Alternatively, the user can be provided with an empty dispenser 10 that needs to be filled prior to a first use. At step 302, the user can place the dispenser 10 on the container support surface 204.

At steps 304 and/or 305, the controller 242 can receive information related to the dispenser 10 based on the container indicia 110 and/or based on user input received through the user interface 240. At step 304 the information sensor 220 can receive information from the container indicia 110 and communicate the information with the controller 242. Optionally, the user can input data through the user interface 240 at step 305.

The controller 242 can control the refill station 200 to dispense a desired chemistry into the dispenser 10 based on the information determined automatically from the container indicia 110 and/or based on information entered manually by a user through the user interface 240. The controller 242 can be programmed with control software for controlling the refill station 200 to dispense one or more chemistries into the dispenser 10 based on the input data received from the container indicia 110 and/or user input at steps 304 and 305. Non-limiting examples of input data include the size and type of dispenser 10, the type of pouch material inside the dispenser 10, the amount of material to dispense, the number of times the dispenser 10 has been refilled, the types of chemistry suitable for dispensing into the dispenser 10, the type of surface to be cleaned, one or more additives to be dispensed and one or more chemistries to be dispensed. The controller 242 can control one or more of the components of the refill station 200, such as the mixing valve 217, the water supply valve 214 and the dispensing system 206 to fill the dispenser 10 with material from the reservoirs 208 based on the input data received at steps 304 and/or 305.

After the controller 242 receives the input data at step 304 and/or 305, the dispensing system 206 can then sealingly engage the dispenser 10 such that the reservoir 208 and the optional water supply source 210 are in fluid communication with the interior of the pouch 74 and the interior of the pouch 74 remains isolated from the atmosphere exterior to the dispenser 10 at step 306. While the method 300 is described as including steps for entering input data prior to the dispenser engaging the dispensing system 206, it is also within the scope of the invention for the input data to be entered simultaneously with or after the dispenser engages the dispensing system 206. The dispensing system 206 and the dispenser 10 can be brought into engagement automatically or manually by a user.

For example, the controller 242 can use the information received by the information sensor 220 to determine the distance to raise the container support surface 204 to bring the dispenser 10 into engagement with the dispensing system 206. The distance the container support surface 204 is raised can be based on the information read by the information sensor 220 or based on one or more position sensors located in the housing 202 or the dispensing system 206 that can determine the height of the dispenser 10, such as an optical sensor. Alternatively, the dispensing system 206 can be provided with a sensor for determining when the dispenser 10 has been brought into engagement with the dispensing system 206, such as a contact or pressure switch or an optical sensor.

Alternatively, the dispenser 10 can be brought into engagement with the dispensing system 206 by a user by manually actuating the container support surface 204, such as through a switch or lever on the user interface 240, to raise the dispenser 10. The controller 242 can be programmed to communicate to the user through the user interface 240 or using an audible signal when the dispenser 10 is engaged with the dispensing system 206 based on the signals received from the one or more positions sensors, for example. In another example, the user can make the determination that the dispenser 10 is engaged either visually or based on resistance to continued raising of the dispenser 10. It is also within the scope of the invention for the dispensing system 206 to be lowered to engage the dispenser 10 or both the dispensing system 206 and the container support surface 204 can be capable of selective movement.

At step 308, the controller 242 can control the components of the refill system 200 to selectively fill the pouch 74 with a cleaning composition based on the input data entered at steps 304 and/or 305. Dispensing the refill composition can include dispensing material from the reservoir 208 into the pouch 74 without diluting the material or dispensing material from the reservoir 208 and water from the water supply source 210 such that the final concentration of dispensed material within the pouch 74 is less than the concentration of the material in the reservoir 208.

In one example, the controller 242 can control the mixing valve 217 and the water supply valve 214 to fill the dispenser 10 with a pre-formulated cleaning composition comprising at least one of a surfactant, solvent, builder, chelating agent, detergent, polymer, anti-soil agent, preservative, oxidizing agent, pH controller, fragrance and combinations thereof from one of the reservoirs 208, based on the input data. The refill station 200 can have one or more reservoirs 208, each containing a concentrated, pre-formulated cleaning composition. The controller 242 can control the amount of material dispensed from a reservoir 208 storing the desired cleaning composition and the amount of water dispensed by the dispensing system 206 into the dispenser 10 such that the final concentration of the pre-formulated cleaning composition in the dispenser 10 is suitable for use in performing a cleaning process.

In another example, the refill station 200 can include multiple reservoirs 208, each containing a component or mixture of components that can be combined with the material stored in the other reservoirs 208 to provide a cleaning composition suitable for use in performing a cleaning process. The controller 242 can control the mixing valve 217 and the water supply valve 214 to dispense the appropriate type and amount of material from one or more of the reservoirs 208 and water from the water supply 210 so that the final formulation and concentration of components in the dispenser 10 correspond to a cleaning composition suitable for use in performing a cleaning process based on the input data from steps 304 and/or 305.

The amount of material dispensed into the pouch 74 can be a predetermined amount independent of the dispenser 10 or can be based on the input data entered at steps 304 and/or 305. For example, when the dispensing system 206 comprises a pneumatic cylinder that draws material from the reservoir 208, and optionally from the water supply source 210, with each stroke, similar to the refilling process disclosed in U.S. Pat. No. 4,938,260 to Hirz, the controller 242 can be programmed to set the number of strokes to a predetermined number such that the pouch 74 can be filled to a desired level regardless of the amount of material that may remain in the pouch 74 from a previous filling process. The number of strokes and the volume dispensed at each stroke can be controlled such that the volume dispensed corresponds to the total volume desired in the pouch 74 at the end of the filling process. The dispenser 10 can also be provided with an overflow port such that any overflow of material, such as can occur if the pouch 74 is not empty when the filling process begins, flows out of the dispenser 10 and into an overflow reservoir that may be provided in the refill system 200.

In another example, the dispensing system 206 can be configured to measure the back pressure from the pouch 74 during the filling process and the controller 242 can be programmed to stop the filling process when the measured back pressure reaches a predetermined amount. In yet another example, the volume dispensed into the pouch 74 can be based on the information received from the dispenser 10 by the information sensor 220 regarding the product type or the volume of the pouch 74. In another example, the amount of material dispensed into the pouch 74 can be based on the weight of the dispenser 10 as determined by the container sensor 230. The weight of the dispenser 10 can also be used prior to filling the dispenser 10 to determine the amount of material that may still remain in the pouch 74 and the amount of material dispensed can be adjusted accordingly.

The end of the dispensing process at step 310 can comprise terminating the flow of material from the reservoir 208 and the water supply source 210. The end of the dispensing process at step 310 can also include automatically disengaging the dispenser 10 from the dispensing system 206 and automatically lowering the container support surface 204 to a predetermined level in preparation for a subsequent filling process. Alternatively, the user can manually disengage the dispenser 10 from the dispensing system 206 by lowering the container support surface 204. The end of the dispensing process at step 310 can also be communicated to the user through the user interface 240 or by an audible signal. The communication of the end of the dispensing process at step 310 can also include indicating to the user that it is safe to remove the dispenser 10 from the container support surface 204 at step 312.

At step 314, the user can use the filled dispenser 10 to perform a cleaning process using the cleaning composition in the dispenser 10. When the dispenser 10 is empty or when the amount of cleaning composition remaining in the dispenser 10 has decreased such that the dispenser 10 no longer satisfactorily dispenses the cleaning composition, the user can refill the empty dispenser 10 at step 301. The steps 301 through 314 can be repeated any number of predetermined times to refill the dispenser 10 such that a user does not have to purchase a new dispenser 10. For example, the dispenser 10 can be refilled until the controller 242 determines that the dispenser 10 has been refilled a predetermined maximum number of times based on the input data entered at 304 and/or 305. In another example, the dispenser 10 can be refilled until a user desires to purchase a new dispenser.

Preferably, the refill method 300 is used to refill a dispenser 10 without the user having to remove the actuator 80 from the container 22 or otherwise manipulate the dispenser 10 such that the user can simply place the dispenser 10 on the container support surface 204 and proceed with the refill method 300. It is also within the scope of the invention for the refill method 300 to be used to refill a dispenser 10 in which the user must remove the actuator 80 prior to placing the dispenser 10 on the container support surface 204 such that the dispensing system 206 can interface directly with the valve assembly 50.

The reservoirs 208 can be refillable or replaceable reservoirs. For example, the reservoirs 208 can be replaceable reservoirs that can be selectively uncoupled from the refill system 200 when the reservoirs 208 are empty and replaced with full reservoirs 208. Alternatively, the reservoir 208 can be a refillable reservoir such that it can be refilled with additional material as needed.

The embodiments of the invention herein described can be used in a retail setting or in an institutional or industrial setting. In a retail setting, a consumer can purchase the dispenser 10 that already contains the cleaning composition to be dispensed within the pouch 74. When the consumer desires to purchase more of the cleaning composition, such as may occur when all of the cleaning composition in the pouch 74 has been dispensed, rather than disposing of the dispenser 10, the consumer can take the dispenser 10 to a retail location having the refill system 200 to refill the dispenser 10 with a desired cleaning composition. The price of refilling a previously purchased dispenser 10 can be less than that of purchasing a new dispenser 10 to motivate a consumer to refill the dispenser 10 rather than purchasing a new dispenser 10. Alternatively, the dispenser 10 can be provided to the consumer empty such that the consumer's initial purchase requires filling the dispenser 10 from the refill station 200 with a desired cleaning composition.

The refill station 200 can be designed as a stand alone unit such that an individual consumer can refill a dispenser 10 by his or herself. Alternatively, the refill station 200 can be provided with trained personnel that perform the refilling process for the individual consumer.

In an institutional or industrial setting, the refill system 200 and dispenser 10 can be provided at a janitorial station, such as is often present at a school or business, in which janitorial staff can refill and use the dispenser 10 to complete their janitorial duties. The janitorial staff can receive training and become certified to use the refill system 200 to minimize the potential risk of injury or damage to the refill system 200.

Figure 5:
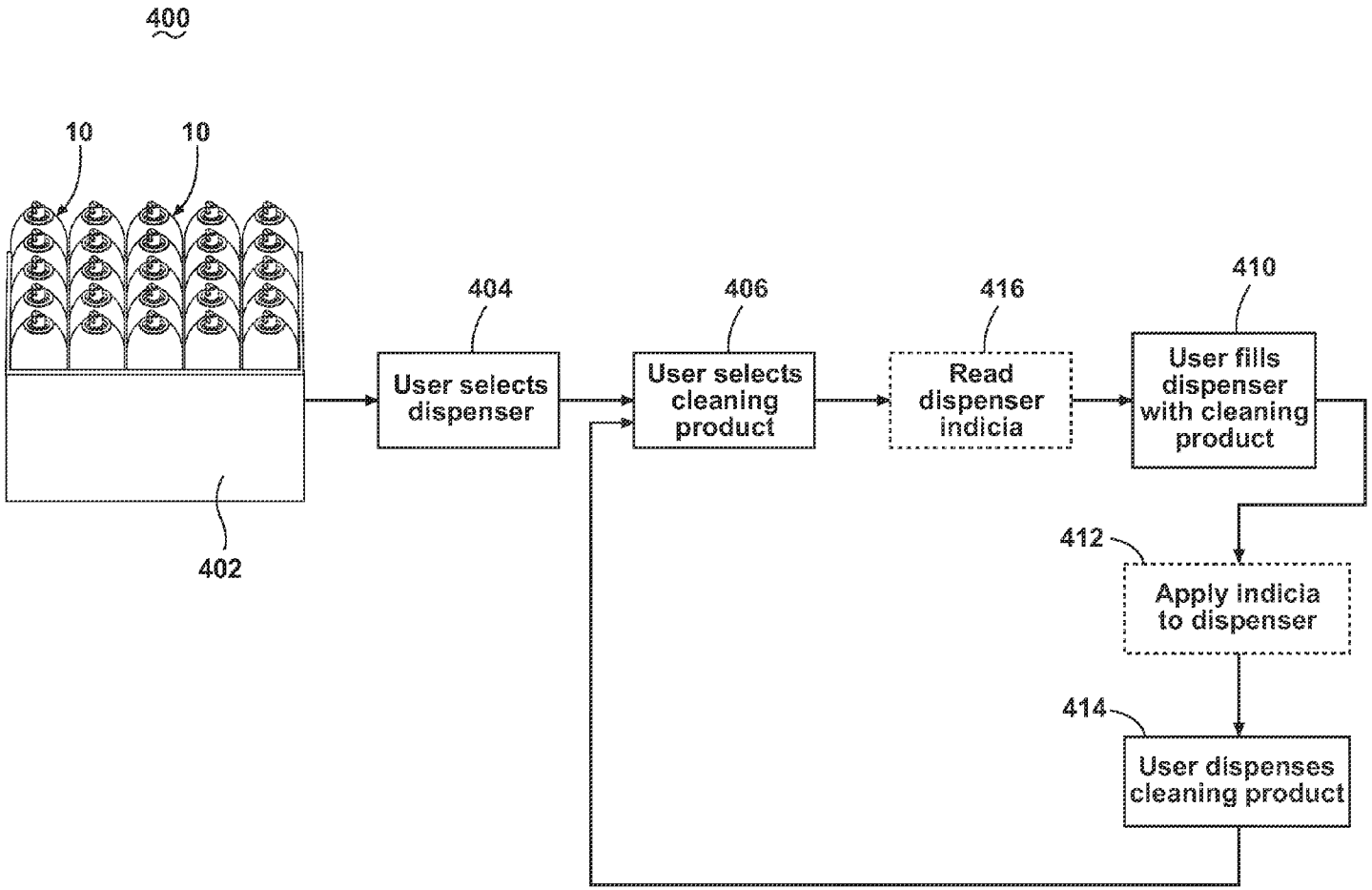
FIG. 5 is a flow chart of a sustainable process for using a pressurized dispenser according to a fourth embodiment of the invention.

Referring now to FIG. 5, a sustainable cleaning process 400 is illustrated comprising the dispenser 10 and refill system 200, which can be used in an institutional or industrial setting. The sustainable cleaning process 400 can be used in an institutional or industrial setting, such as by a janitorial service in a business or school, for example, in which a single dispenser 10 can be filled and refilled with a desired cleaning product.

As illustrated in FIG. 5, a purchaser, such as a janitorial service, can purchase one or more empty dispensers 10 at step 402. The dispensers 10 can be made available to a user, such as a janitor, to fill using the refill system 200 for performing one or more cleaning tasks. The dispensers 10 can all be the same dispenser. Alternatively, the dispensers 10 can be different, such that the user can select a dispenser 10 according to the user's specific needs at step 404.

For example, the user can be provided with dispensers 10 having a different shape, size, actuator and/or pouch 74 according to the intended manner of use of the dispenser 10 and the desired cleaning composition. The container 22 can be made from metal or from plastic, as described above. The container 22 can be provided with a recognizable shape and/or color, so that a user can recognize specific container shapes that are suitable for different cleaning needs. For example, a container 22 suitable for storing a bathroom cleaning composition can have one shape and/or color and a container 22 suitable for storing a carpet stain removing composition can have another shape and/or color, recognizably different from the container 22 suitable for storing the bathroom cleaning composition. Differentiation in shape and/or color of the container 22 can aid the user in selecting an appropriate dispenser 10 based on the user's needs and can also provide the dispenser 10 with brand recognition.

Figure 6:
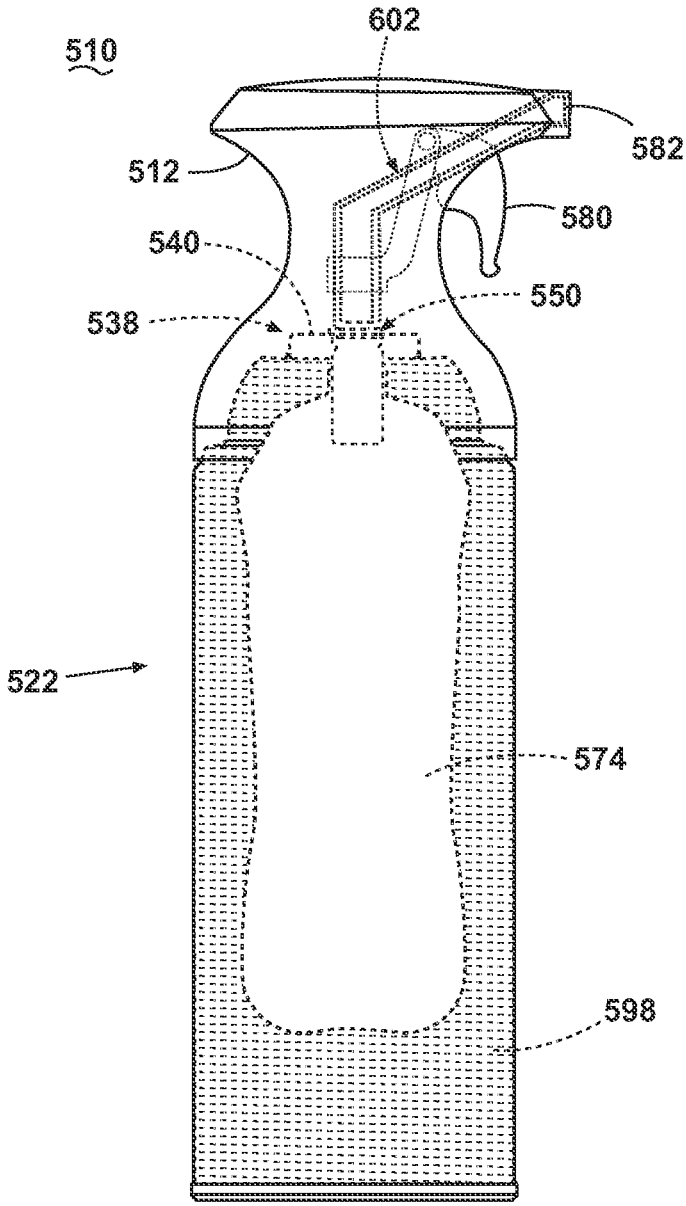
FIG. 6 is a side elevational view of a pressurized dispenser according to a fifth embodiment of the invention.

In another example, the user can select a dispenser 10 based on the desired type of actuator, such as the press button actuator 80, illustrated in FIG. 1, or the trigger actuator 580 illustrated in FIG. 6, for example.

In yet another example, the user can select a dispenser 10 based on the type of cleaning composition the user desires to fill the dispenser 10 with based on the compatibility of the pouch 74 with the desired cleaning composition. If the user intends to fill the dispenser 10 with a hydrogen peroxide-based cleaning product, the user can select a dispenser 10 having a pouch 74 suitable for storing a hydrogen peroxide-based cleaning product. Each dispenser 10 can be provided with machine readable indicia 110 indicating what cleaning products are suitable for use with each type of dispenser 10 and what cleaning products are not suitable, which can be used by the controller 242 of the refill system 200 to determine if it is appropriate to dispense a user-selected cleaning composition into the dispenser 10. Each dispenser 10 can also be provided with user-identifiable indicia indicating what cleaning products are suitable for use with each type of dispenser 10 and what cleaning products are not suitable.

At step 406, the user can select a desired cleaning product either automatically, based on the container indicia 110, or manually, based on data input through the user interface 240, as described above with respect to steps 304 and 305 of the method 300 illustrated in FIG. 4. After the user has selected the desired dispenser 10 and the desired cleaning product, the user can fill the dispenser 10 with the desired cleaning composition at step 410 according to the cleaning task that is to be performed using the refill system 200. The user can fill the dispenser 10 using the refill system 200 as described above with reference to the method 300 illustrated in FIG. 4 with the desired cleaning composition.

The sustainable cleaning process 400 can also include an optional step 412 in which the refill system 200 includes a printer capable of printing a label corresponding to the cleaning product being dispensed into the dispenser 10. The label can comprise a pressure-sensitive adhesive surface, as is known in the art, for adhering the label to the dispenser 10. The label can include information such as the type of cleaning composition in the dispenser 10, limitations on the type of cleaning composition that can be dispensed into the dispenser 10 during a subsequent filling process, the number of times the dispenser 10 has been filled and instructions or warnings to the user, for example. The information can be printed on the label so that it can be read by the information sensor 220. Alternatively, the information can be printed on the label so that the user can read the information from the label and input the information manually through the user interface 240.

At step 414, the user can dispense the cleaning composition from the dispenser 10 while performing one or more cleaning tasks. When all or most of the cleaning composition has been dispensed from the dispenser, the user can return to step 406 to refill the dispenser with a desired cleaning composition. In this manner, the user can reuse the dispenser 10 multiple times without generating the waste that comes from disposing of a dispenser 10 when the cleaning composition has been used up.

At optional step 416, the information sensor 220 can read the information from the label applied at step 412. The controller 242 can use the information from the label applied at step 412 in controlling the refill station 200 to fill the dispenser 10 with a desired cleaning composition at step 410.

For example, the refill system 200 can print a label having a pressure sensitive adhesive on one side that can be adhered to the container 22 by the user at step 412 after a filling process indicating the contents of the dispenser 10. The label can also be printed with machine readable indicia that can be read by the information sensor 220 during a subsequent filling process. The label indicia can then be used by the controller 242 to determine the previous contents of the dispenser 10 and determine whether or not it is appropriate to dispense the user's selected cleaning composition in a subsequent filling process.

For example, if a user initially fills the dispenser 10 with a cleaning composition containing a chlorine-based bleach at step 410, this information can be printed on the label generated by the refill system 200 in the form of machine readable indicia at step 412. If the user attempts to fill the dispenser 10 with an ammonia-based cleaner during a subsequent filling process, the controller 242 can receive the information read by the information sensor 220 at step 416 regarding the previously filled cleaning product and determine that it is unsafe to dispense the currently selected cleaning composition. The controller 242 can then decide to not dispense the selected product and alert the user either visually through the user interface 240 or audibly.

It is also within the scope of the invention for the refill system 200 to print a label that is readable by a user indicating any potential safety and/or compatibility issues regarding the dispensed cleaning product to the user. For example, the label can include the warning "Do not fill with ammonia-based products."

In another example, the dispenser 10 and the refill system 200 can be provided with a lock and key feature that prevents the refill system from filling a dispenser with a composition that is incompatible with the particular dispenser 10. The shape of at least a portion of the container 22, such as a bottom surface, and/or the shape of a cover or actuator can be such that the refill system 200 can recognize the shape and determine whether or not the dispenser 10 is compatible with the cleaning product selected at step 406. For example, a perimeter of the bottom surface of a container 22 can be provided with a particular shape that can be received by a corresponding recess in the container support surface 204. The container support surface 204 can be provided with a sensor, such as an optical sensor or pressure sensor capable of determining the presence of the container 22 within the recess and the controller 242 can determine if the cleaning product selected at step 406 is compatible with the container 22.

While the process 400 is described in the context of an industrial or institutional setting, it will be understood that the process 400 can be used in a similar manner in a retail setting as discussed previously. A consumer can purchase a dispenser 10 from a retailer and fill the dispenser 10 with a desired cleaning composition at a retail location having the refill system 200 according to the process 400.

The refill system 200 can be used to fill the dispenser 10 with a pre-formulated cleaning composition and/or with a custom-made cleaning composition. In one example, the refill system 200 can be provided with multiple reservoirs 208 each containing a pre-formulated cleaning composition for filling into the dispenser 10. Each reservoir 208 can be filled with a fully reconstituted cleaning composition or a concentrated cleaning composition that is diluted with water from the water supply source 210 upon filling the dispenser 10.

Each reservoir 208 can be filled with a cleaning composition designed for use in performing different cleaning tasks or for cleaning different surfaces. For example, the refill system 200 can have reservoirs 208 storing cleaning compositions suitable for use on different surfaces, such as hard surfaces, non-limiting examples of which include tile, glass, mirrors, laminate flooring, wood and bathroom surfaces, and soft surfaces, non-limiting examples of which include carpet, rugs, upholstery and drapery. Alternatively, the reservoirs 208 can store cleaning compositions that can be selected by the user based on the cleaning task, non-limiting examples of which include cleaning compositions for disinfecting a surface, deodorizing, stain removal, dusting and window cleaning, for example.

In addition, it is also within the scope of the invention for the refill system 200 to comprise reservoirs 208 containing additives that a user can select to dispense with a selected cleaning composition during a filling process. Non-limiting examples of suitable additives that may be dispensed with a selected cleaning composition include a colorant and a fragrance.

As described above, the user can select the desired cleaning composition to fill the dispenser 10 with through the user interface 240. Alternatively, the cleaning composition to fill the dispenser 10 with can be automatically determined by the controller 242 based on the container indicia 110 read by the information sensor 220. The user can also be provided with the opportunity to tailor the dispensed cleaning composition according to the user's specific needs through the user interface 240 by selecting one or more additives to be dispensed with the selected cleaning composition into the dispenser 10. In this manner, the dispensed cleaning composition can be customized according to the user's needs.

It is also within the scope of the invention for the reservoirs 208 to contain different components that can be combined to provide a cleaning composition according to the user's needs. For example, the refill system 200 can be provided with multiple reservoirs 208 containing one or more surfactants, solvents, builders, chelating agents, detergents, polymers, anti-soil agents, preservatives, oxidizing agents, pH controller, fragrance or mixtures thereof. In this manner, the refill system 200 can be used to dispense custom-made cleaning compositions. The controller 242 can be programmed so as to dispense the appropriate amount of each component from the different reservoirs 208 into the dispenser 10 according to the cleaning composition selected by the user through the user interface 240 or as determined by the controller 242 from the container indicia 110.

Alternatively, the user can select the amount of each component to dispense to create a desired cleaning composition. In this case, the user can be provided with training or information on recommended amounts of each component to dispense to create a desired cleaning composition.

FIGS. 6-10, illustrate several embodiments of a pressurized dispenser having an interface for engaging a filling head of the refill system 200 during a filling process for filling the dispenser, such as can occur at step 306 of the method 300 illustrated in FIG. 4. It will be understood that any of the elements or features described for a single embodiment can be used with any other embodiment of the invention described herein.

FIG. 6 illustrates a pressurized dispenser 510 that is similar to the dispenser 10 except for the dispenser 510 is provided with a trigger actuator 580 instead of the push button actuator 80 illustrated in FIG. 1. Therefore, elements of the dispenser 510 similar to those of the dispenser 10 are numbered with the prefix 500.

As illustrated in FIG. 6, the dispenser 510 can comprise a container 522, a pouch-on-valve assembly 538 for storing a cleaning composition and regulating its dispensing, a cover 512 and a trigger actuator 580 operably coupled to the pouch-on-valve assembly 538 for selectively dispensing the cleaning composition onto the surface to be cleaned. The pouch-on-valve assembly 538 can comprise a pouch 574 received within the container 522 for storing a supply of cleaning composition and a valve assembly 550 that is hermetically sealed to the pouch 574 and coupled with the trigger actuator 580. The valve assembly 550 can be operably coupled with the trigger actuator 580 such that the trigger actuator 580 can be used to selectively dispense the cleaning composition from the pouch 574 onto a surface to be cleaned through a dispensing flow path 602 that is coupled with a terminal orifice 582. The pouch-on-valve assembly 538 can further comprise a valve mounting cup 540 that mounts the pouch-on-valve assembly 538 to the container 522.

A cleaning composition can be delivered to the surface to be cleaned from the pouch 574 via the dispensing flow path 602, which is in fluid communication with the push valve assembly 550 that is sealed to the flexible pouch 574. Positive pressure inside the container 522 is generated by a pressurized gas 598 that is injected during the container filling process into the space between an inner surface 532 of the container 522 and the pouch 574. The pressurized gas 598 is filled to a level sufficient for generating the required force to deliver the cleaning composition to the surface to be cleaned with spray characteristics, i.e. the force of the spray, the diameter of the spray, the type of particle sprayed, that is desirable for the intended application.

The cover 512 can be removably coupled with the container 522 so that it can be selectively removed from the container 522 to expose the valve assembly 550 for connection to a filling head of the refill system 200 configured with a suitable fitting adapted to interface with the valve assembly 550 during a filling process. The flow path 602 can be coupled with the cover 512 such that when the cover 512 is removed, the flow path 602 is disengaged from the valve assembly 550. The cover 512 can be removably coupled to the container 522 in any suitable manner. For example, the cover 512 can be designed so as to snap-fit onto an upper portion of the container 522 or onto the valve cup 540.

Figure 7:
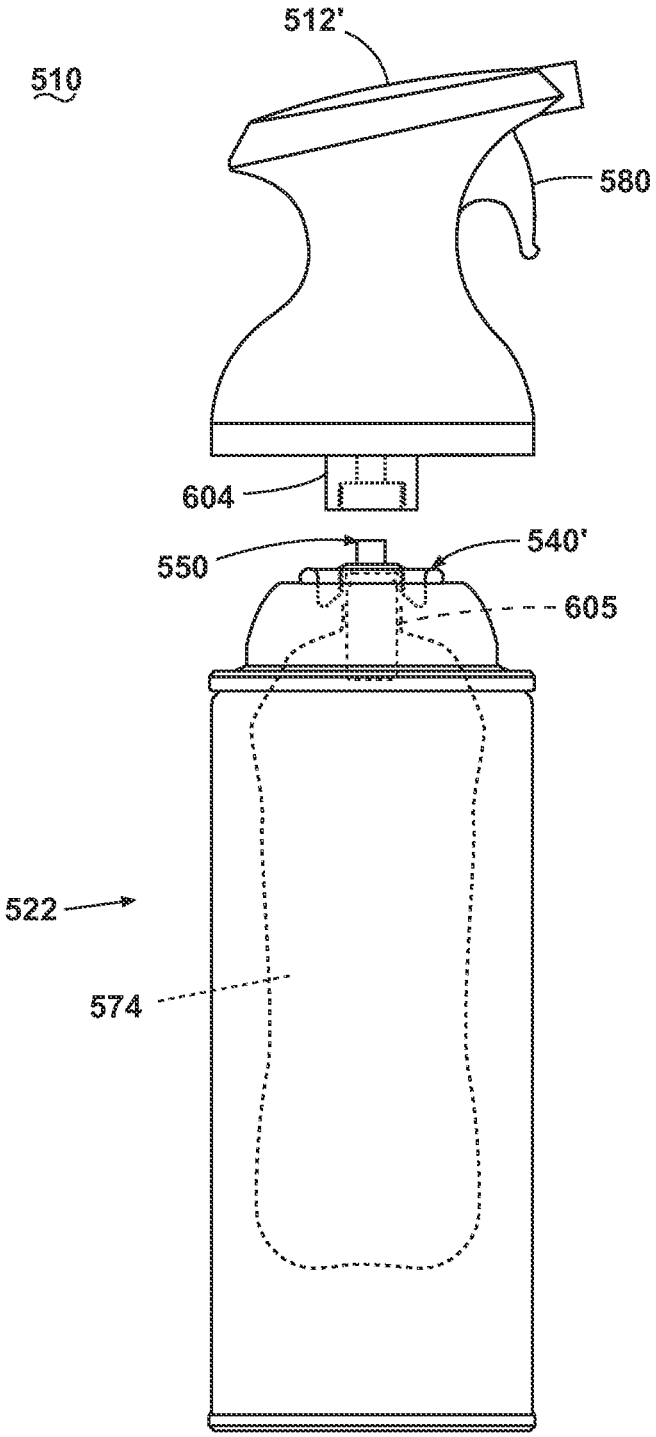
FIG. 7 is a side elevational view of a pressurized dispenser according to a sixth embodiment of the invention.

In another example, illustrated in FIG. 7, the dispenser 510 can be provided with a cover 512' which is similar to the cover 512 except that the cover 512' has a threaded neck portion 604. The container 522 can be provided with a mounting cup 540' having a threaded portion 605 for threading onto the threaded neck portion 604 of the cover 512'. The threaded neck portion 604 and threaded portion 605 on the mounting cup 540' can comprise corresponding male and female threads, respectively. Conversely, the threaded neck portion 604 can comprise female threads whereas the threaded portion 605 can comprise corresponding male threads. In this manner, the user can selectively couple and remove the cover 512' by simply threading and unthreading the threaded neck portion 604 and threaded portion 605 by rotating the container 522 relative to the cover 512', as is known in the art. The flow path 602 can be coupled with the cover 512' such that when the cover 512' is removed, the flow path 602 is disengaged from the valve assembly 550.

For example, once the cover 512' is removed, a female orifice in the male threaded valve cup 605 is exposed. A suitable fitting from the refill machine 200 is configured to be activated to operably connect to the female orifice and dispense solution into the pouch 574. In this manner, the threaded valve cup 605 provides an easy way to repeatedly remove and replace the cover 512' during multiple fillings without damage.

Figure 8:
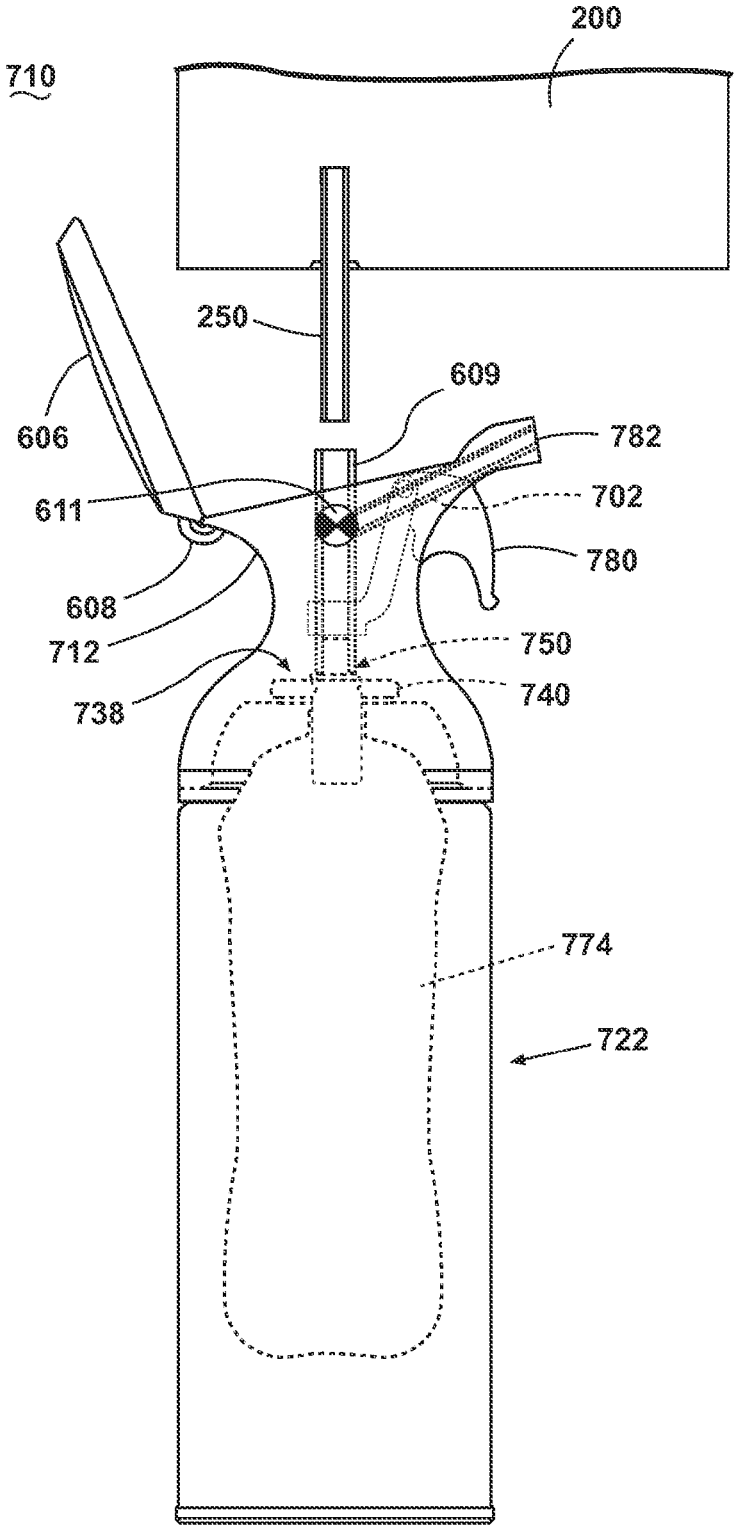
FIG. 8 is a side elevational view of a pressurized dispenser and a refill system according to a seventh embodiment of the invention.

FIG. 8 illustrates another example of a dispenser 710 having an interface for engaging the refill system 200 during a filling process. The dispenser 710 is similar to the dispenser 510 except for the manner in which a filling head 250 of the refill system 200 is coupled with a valve assembly 750. Therefore, elements of the dispenser 710 similar to those of the dispenser 510 are numbered with the prefix 700.

The dispenser 710 can comprise a container 722, a pouch-on-valve assembly 738 for storing a cleaning composition and regulating its dispensing, a cover 712 and a trigger actuator 780 operably coupled to the pouch-on-valve assembly 738 for selectively dispensing the cleaning composition onto the surface to be cleaned. The pouch-on-valve assembly 738 can comprise a pouch 774 received within the container 722 for storing a supply of cleaning composition and a valve assembly 750 that is hermetically sealed to the pouch 774 and coupled with the trigger actuator 780. The valve assembly 750 can be operably coupled with the trigger actuator 780 so that the trigger actuator 780 can be used to selectively dispense the cleaning composition from the pouch 774 through a dispensing flow path 702 to a terminal orifice 782 for dispensing the cleaning composition onto a surface to be cleaned. The pouch-on-valve assembly 738 can further comprise a valve mounting cup 740 that mounts the pouch-on-valve assembly 738 to the container 722.

The cover 712 can be provided with a movable upper portion 606 that can be selectively rotated about a hinge 608 to expose the dispensing flow path 702 and the valve assembly 750 housed within the cover 712. The dispensing flow path 702 can be provided with an extension 609 in the form of a hollow conduit to operably couple to a suitable fitting of the filling head 250 of the refill system 200. The filling head 250 and the extension 609 can couple in either a male-female or a female-male configuration. The dispensing flow path 702 can be designed so that when the filling head 250 engages with the dispensing flow path 702 during a filling process, material is filled into the pouch 774 and does not flow out the terminal orifice 782.

For example, the extension 609 can be provided with a one-way check valve 611 that opens for material to flow into the pouch 774 during a filling process and closes to restrict material flow out of the pouch 774 through the extension 609 when the trigger actuator 780 is depressed by a user during a cleaning process. The check valve 611 can be configured open for material flow through the extension 609 and into the pouch 774, and preclude material flow through the dispensing flow path 702 and out the terminal orifice 782. A duck bill check valve or any other suitable type of check valve can be used to control the flow of material through the dispensing flow path 702. During dispensing, the check valve 611 opens for material dispensing through the terminal orifice 782 but not through the extension 609.

Alternatively, the extension 609 can be in the form of a hollow conduit having a closed bottom and a hole in a sidewall of the extension 609. During the filling process, the filling head 250 is configured to couple with the extension 609 and push the extension 609 down into the dispensing flow path 702 to position the hole in the sidewall of the extension 609 in fluid communication with the dispensing flow path 702. In this manner, material can be dispensed by the filling head 250 into the extension 609 and through the hole into the dispensing flow path 702. The extension 609 can be configured so that when the extension 609 is depressed into the dispensing flow path 702, material flowing from the filling head 250 through the hole in the extension 609 can only flow through the dispensing flow path 702 into the pouch 774 and cannot flow to the terminal orifice 782. The extension 609 can also be provided with a shoulder that can couple with the valve assembly 750 when depressed into the dispensing flow path 702 by the filling head 250, thus opening the valve assembly 750 for material flow into the pouch 774.

In another alternative, the dispensing flow path 782 can be provided with a bistable flap that controls the flow of fluid through the dispensing flow path 782. The bistable flap can configured to move from a first position in which the flap blocks the flow of material through the extension 609 and a second position in which the flap blocks the flow of material to the terminal orifice 782. When the extension 609 is slid into the dispensing flow path 702 by the filling head 250 during a filling process, the extension 609 can move the flap into the second position in which the flow of material to the terminal orifice 782 is blocked. In this manner, material from the filling head 250 can flow through the extension 609 into the pouch 774 and not exit through the terminal orifice 782. During use, the flap remains in the first position wherein material from the pouch 774 is only dispensed through the terminal orifice 782 and not through the extension 609.

While the extension 609 has been described in the context of a dispenser 710 having a cover 712 with a movable upper portion 607 that can be opened to provide access to the extension 609 during a filling process, it is also within the scope of the invention for the extension 609 to be used with a dispenser having a cover 712 that does not have a movable upper portion 607. According to this embodiment, the extension 609 can extend from the dispensing flow path 702 to an upper portion of the cover 712 and end in a port with which the filling head 250 can engage. In this manner, the filling head 250 can engage with the dispensing flow path 702 for filling the dispenser 710 without the user having to open or remove a portion of the cover 712.

In addition, while the extension 609 is illustrated as a vertical extension extending upwards toward the upper portion 606 of the cover 712, it is also within the scope of the invention for the extension 609 to extend horizontally or at any angle between horizontal and vertical. For example, the extension 609 can extend vertically towards the upper portion 606 of the cover 712, terminating in a port for engaging the filling head 250. Alternatively, the extension 609 can extend horizontally towards a side wall of the cover 712, terminating in a port for engaging the filling head 250.

In another example, rather than filling the pouch 774 through the dispensing flow path 702, the dispenser 710 can be provided with a separate material flow path (not shown) that circumferentially surrounds the outside of the dispensing flow path 702. When the filling head 250 is engaged during a filling process, material can be dispensed from the filling head 250 with enough pressure to force its way around the stem gasket of the valve assembly 750 and into the pouch 774. The separate material flow path can be accessible through a filling port provided in the cover 712. Alternatively, the upper portion 606 of the cover 712 can be rotated about its hinge 608 to provide access to the separate material flow path during a filling process.

While the dispensing flow path 702 and the material flow path are described as coupling with the pouch 774 through the same valve assembly 750, it is also within the scope of the invention for the material flow path to couple with a separate valve assembly for filling the pouch 774 during a filling process.

Figure 9:
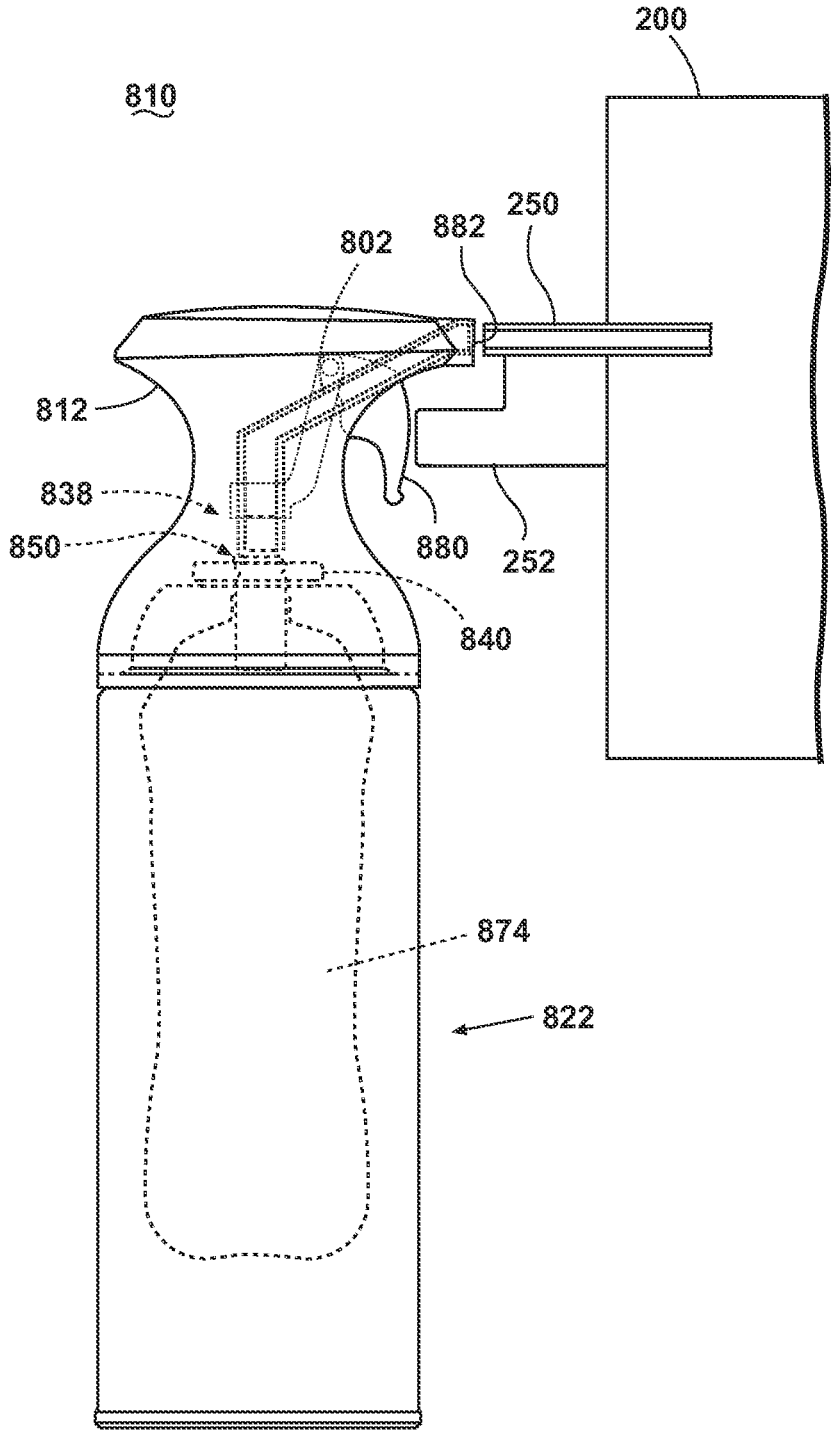
FIG. 9 is a side elevational view of a pressurized dispenser and a refill system according to an eighth embodiment of the invention.

Referring now to FIG. 9, another example of a dispenser 810 having an interface for coupling with the refill system 200 during a filling process is illustrated. The dispenser 810 is similar to the dispenser 710 except for the manner in which a filling head 250 of the refill system 200 is coupled with a valve assembly 850. Therefore, elements of the dispenser 810 similar to those of the dispenser 710 are numbered with the prefix 800.

The dispenser 810 can comprise a container 822, a pouch-on-valve assembly 838 for storing a cleaning composition and regulating its dispensing, a cover 812 and a trigger actuator 880 operably coupled to the pouch-on-valve assembly 838 for selectively dispensing the cleaning composition onto the surface to be cleaned. The pouch-on-valve assembly 838 can comprise a pouch 874 received within the container 822 for storing a supply of cleaning composition and a valve assembly 850 that is hermetically sealed to the pouch 874 and coupled with the trigger actuator 880. The valve assembly 850 can be operably coupled with the trigger actuator 880 so that the trigger actuator 880 can be used to selectively dispense the cleaning composition from the pouch 874 through a dispensing flow path 802 to a terminal orifice 882 for dispensing the cleaning composition onto a surface to be cleaned. The pouch-on-valve assembly 838 can further comprise a valve mounting cup 840 that mounts the pouch-on-valve assembly 838 to the container 822.

As illustrated in FIG. 9, the refill system 200 can be provided with a filling head 250 having a fitting that is configured to couple to the terminal orifice 882 during a filling process for dispensing material from the refill system 200 into the pouch 874. During the filling process, an actuator extension 252 of the refill system 200 is configured to move the trigger actuator 880 to open the valve assembly 850 so that material can flow from the refill system 200 into the pouch 874 through the terminal orifice 882 and the dispensing flow path 802.

Alternatively, rather than filling through the dispensing flow path 802, the dispenser 810 can be provided with a separate filling path circumferentially surrounding the dispensing flow path 802 and sealed on the mounting cup 840 at a first end and the terminal orifice 882 at a second end. During the filling process, the fluid can be dispensed from the refill system 200 through the filling path at a high enough pressure such that the valve stem of the valve assembly 850 is depressed and the gasket is deflected. The fluid then flows over the gasket, through the valve stem and into the pouch 874. This filling path is larger than the fluid path inside the valve stem (as described above with respect to dispenser 10 of FIG. 2) and therefore the fluid can be injected into the pouch 874 at a faster rate. The terminal orifice 882 can be provided with a spring to bias the terminal orifice 882 in a first position in which access to the filling path is blocked. During a filling process, the filling head 250 can interface with the terminal orifice 882 through a suitable fitting and press the terminal orifice 882 against the bias of the spring to provide access to the filling path. The fluid can then be filled into the pouch 874 through the depressed valve stem and deflected gasket. The actuator extension 252 can engage the trigger actuator 880 as described above to open the valve assembly 850 to facilitate filling the pouch 874.

Alternatively, rather than a separate filling path circumferentially surrounding the dispensing flow path 802, the pouch 874 can be refilled by removing the cover 812 carrying the dispensing flow path 802, exposing the valve stem and mounting cup 840. The refill system 200 can then be provided with a fitting that is configured to seal onto the mounting cup 840 for filling directly into the pouch 874.

In another example, access to the dispensing flow path 802 through the terminal orifice 882 can be selectively controlled using a twist-lock cap which can be selectively rotated or twisted from a first position in which the terminal orifice 882 is exposed and material can be dispensed onto a surface to be cleaned and a second position in which the terminal orifice 882 is blocked and access to the filling path is exposed. One example of a twist-lock cap suitable for use with the invention is the Moritz hoodless locking actuator from Seaquist Perfect Dispensing (Cary, Ill.).

Figure 11A:
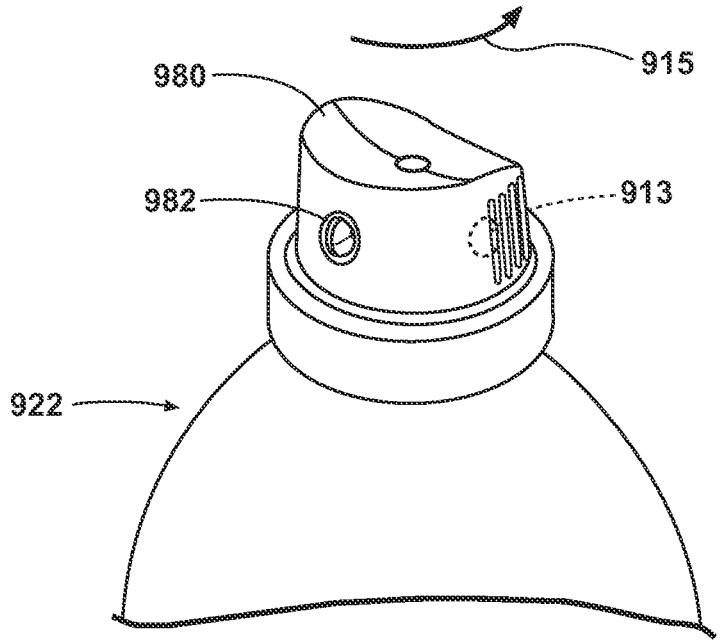
FIGS. 11A and 11B are a perspective view of a pressurized dispenser according to a tenth embodiment of the invention.
Figure 11B:
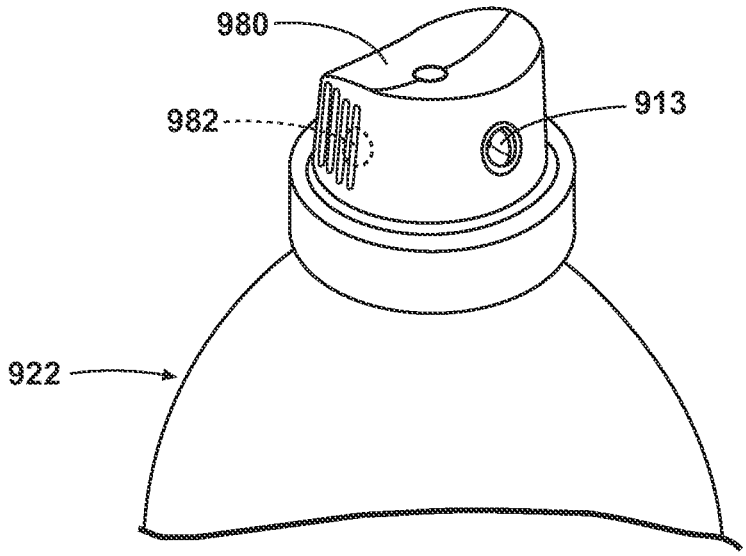

As illustrated in FIGS. 11A and 11B, a twist-lock cap 980 has a first terminal orifice 982 for use in dispensing material from the container 922 onto a surface to be cleaned. As illustrated by arrow 915, the user can selectively rotate the twist-lock cap 980 to expose a second terminal orifice 913 to provide access to a filling path for filling material into the container 922 using the refill system 200 as illustrated in FIG. 11B. At the end of the filling process, the user can rotate the twist-lock cap 980 back to the first position illustrated in FIG. 11A to block access to the second terminal orifice 913 and expose the first terminal orifice 982 for dispensing material from the container 922 onto a surface to be cleaned. It is also within the scope of the invention for the twist-lock cap to be provided with features such that the twist-lock cap is only rotatable by the refill system 200 during a filling process.

Figure 10:
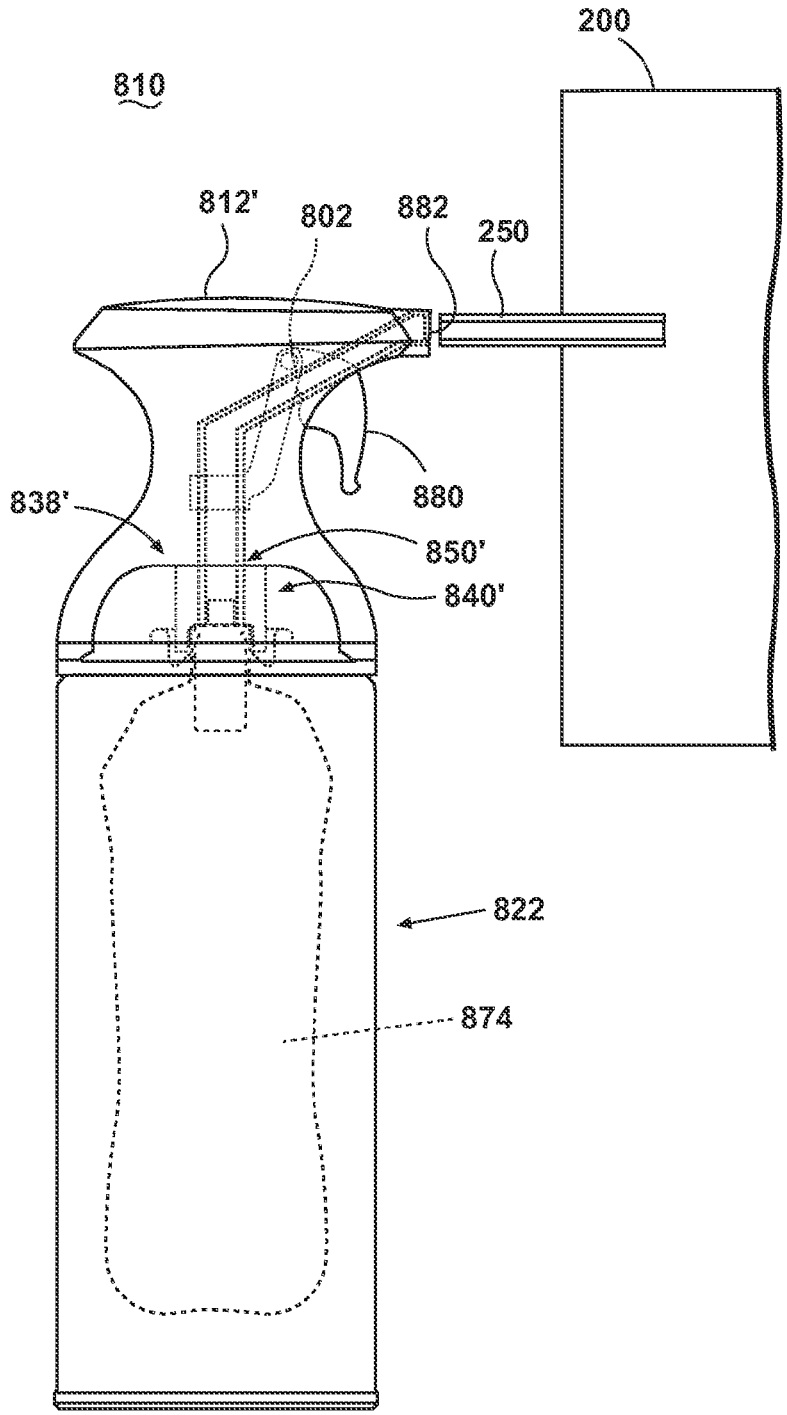
FIG. 10 is a side elevational view of a pressurized dispenser and a refill system according to a ninth embodiment of the invention.

In another example, illustrated in FIG. 10, the dispenser 810 can be provided with a pouch-on-valve assembly 838' having a valve assembly 850' similar to the valve assembly 850 except that the valve assembly 850' is permanently open when a cover 812' is coupled with the container 822. The cover 812' is similar to the cover 512' illustrated above in FIG. 7 in that it is provided with a threaded neck portion which can thread onto a corresponding threaded portion of a mounting cup 840'. When the threaded neck portion 604 of the cover 812' is threaded onto the threaded portion 605 of the mounting cup 840' the valve assembly 850' is permanently opened so that during a filling process, the refill system 200 does not require the use of an actuator extension 252 for depressing the trigger actuator 880 to open the valve assembly 850' for filling into the pouch 874.

In yet another example, the pouch 874 can be provided with two pouch-on-valve assemblies 838. The first pouch-on-valve assembly 838 can be coupled with the dispensing flow path 802 as described above for dispensing material from the pouch 874 to a surface to be cleaned. The second pouch-on-valve assembly 838 can couple with a refill port provided anywhere on the container 822, such as a side or bottom of the container 822. The filling head 250 can couple with the refill port during a filling process to fill the pouch 874 through the second pouch-on-valve assembly 838.

In still another example, the dispenser 810 can be provided with an elastomeric septum through which the refill system 200 can inject material into the pouch 874. In this example, the septum can be provided directly on the pouch-on-valve assembly 838 or the septum can be located on an exterior of the container 822 or the cover 812 and couple with a material flow path fluidly coupled with the contents of the pouch 874. The refill system 200 can be configured with a suitable fitting, such as a needle, that can pierce the septum and deliver material from the refill system 200 into the pouch 874. For example, the septum can be provided on a bottom of the container or on an upper portion of the cover 812.

While the embodiments of the invention have been described in the context of a dispenser 510, 710 and 810 having a trigger actuator, 580, 780 and 880, respectively, it is within the scope of the invention for the embodiments of the invention to be used with a dispenser having any type of actuator, such as the push button actuator 80 illustrated in FIG. 1.

The pressurized dispensers 10, 510, 710 and 810 and the refill system 200 described herein can provide a number of benefits to the user and the environment. There is increasing public, political and economic pressure to provide products that have less negative environmental and health impacts and meet sustainability goals set by local, state and federal agencies.

The pressurized dispenser described herein provides several advantages over previous aerosol-based dispensers. One such advantage is the impact of the package on the environment and human health. There is currently increasing pressure in society, in both the marketplace and in the government, to promote development of products that have minimal impact on the environment and human health. Large retailers are increasingly pressuring vendors and suppliers to provide products that reduce waste and have a decreasing impact on the environment and human health. The United States Environmental Protection Agency (EPA) has also initiated a program called "Design for the Environment" (DfE) that certifies products as meeting stringent standards for environmental and health impacts.

The dispenser described herein provides a dispenser for delivering a cleaning composition to a surface to be cleaned under pressure without the disadvantages of traditional aerosol dispensers. Traditional aerosol dispensers that utilize propellants such as volatile organic compounds and compressed gasses like nitrous oxide can contribute to ground-level ozone levels. Traditional dispensers utilizing traditional propellants such as these are believed to be ineligible for the EPA's DfE program.

The pressurized dispenser described herein can utilize compressed air or nitrogen gas, which have minimal environmental impact, to pressurize the cleaning composition. In addition, the cleaning composition can also be provided free of volatile organic compounds, resulting in a dispenser and cleaning composition package that is free of volatile organic compounds and has minimal impact on the environment and human health.

Because the pressurized dispenser according to the invention stores the cleaning composition within a pouch, separate from the pressurizing gas, only the cleaning composition is dispensed during use. Therefore, the pressurized dispenser can be refilled with a cleaning composition without having to re-pressurize or refill the pressurizing gas. This simplifies the refill station and the refilling process in that the refill station does not have to store large tanks of pressurized gas for dispensing under pressure into a dispenser during a refill process. In addition, because the pressurizing gas is not dispensed during use, the same volume of pressurizing gas can be used multiple times. In essence, the pressurizing gas is recycled with each use, increasing the lifetime and sustainability of the pressurized dispenser.

Traditional aerosol dispensers, in which the propellant is stored with the cleaning composition, dispense the propellant with the cleaning composition. Therefore, to refill a traditional aerosol dispenser would require refilling a container with both the propellant and the cleaning composition. Storing large tanks of pressurized propellant can raise safety concerns in terms of storing large amounts of pressurized gas that may also be flammable. In addition, traditional aerosols most commonly use unstenched, flammable gas, such as propane and isobutane, for example, as a propellant, further increasing safety concerns, as flammable gas leaks can go undetected. The pressurized dispenser and refill system according to the invention overcomes these safety disadvantages of a traditional aerosol dispenser.

In addition, unlike the pressurized dispenser according to the invention, the propellant used with traditional aerosol dispensers is dispensed during use and cannot be reused, thus decreasing the sustainability of the product. The dispensed propellant can also negatively impact the environment and human heath, as discussed above.

Refilling the pressurized dispenser according to the invention as described herein provides a product that can be used multiple times during which only the portion of the product necessary to perform a task is consumed. According to the invention, only the cleaning composition is consumed during the cleaning process, the container and the pressurizing gas are not consumed and therefore can be used multiple times to store and dispense a cleaning composition.

Traditional dispensers in which the consumer discards the container when the cleaning solution has been consumed generates waste when the container is discarded and also requires large amounts of energy to ship large amounts of filled containers to meet consumer and industrial demand. The pressurized dispenser and refill system according to the invention generate less waste and require less energy to ship because the pressurized dispenser and pressurizing gas can be used multiple times. Additionally, a refill system that utilizes concentrates that are blended with water provided at the site of the dispensing system further reduces energy consumption since significantly less water is being shipped.

In the industrial and institutional market, such as in building and commercial services, and janitorial and housekeeping industries, there is increasing pressure from local, state and federal government agencies to increase sustainability of the services provided by these industries. In most cases, traditional aerosol products are not capable of meeting the sustainability guidelines set forth by these agencies. As discussed above, traditional aerosol products often use propellants such as volatile organic compounds and compressed gasses like nitrous oxide that can contribute to ground-level ozone levels. In addition, as discussed above, there are feasibility and safety concerns associated with refilling a traditional aerosol product. Therefore, in settings where sustainability guidelines are present, typically only non-aerosol, manual trigger or pump-type dispensers are used, as these types of dispensers do not use propellants, can be used multiple times before failing and going into the waste stream, and can be easily refilled.

The pressurized dispenser according to the invention has several benefits compared to un-pressurized, manual trigger or pump-type dispensers and can also meet sustainability guidelines when refilled according to the embodiments of the invention described herein. The pressurized dispenser according to the invention can be dispensed at any angle, provides improved and more even coverage of a surface during a cleaning process and wastes less cleaning composition during a cleaning process compared to a non-pressurized dispenser. In addition, the repeated squeezing and pumping action required to dispense a solution from an un-pressurized, manual trigger or pump-type dispenser can be strenuous on a user's hand, wrist and arm and can potentially lead to repetitive motion injuries such as carpal tunnel syndrome. This can be especially apparent in an industrial or institutional setting where a user is often regularly and repeatedly using a trigger or pump-type dispenser for long periods of time in the course of performing his/her duties. The advantages of a pressurized dispenser can facilitate quicker surface coverage compared with a trigger sprayer, which can be beneficial in cases of disease outbreaks, such as at a school or on a cruise ship, where large surface areas need to be covered. The pressurized dispenser according to the invention primarily uses the pressure from the pressurizing gas to dispense the cleaning composition and therefore requires less effort on the part of the user in dispensing the solution, leading to less strain on the user's hand, wrist and arm.

Refilling the pressurized dispenser according to the system and methods described herein provides a cleaning product that can meet sustainability guidelines that might otherwise restrict the use of pressurized products in an industrial or institutional setting.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A sustainable system for refilling a pressurized fluid dispenser comprising:

a container body having a first fluid dispenser that includes a valved opening having a normally closed value;

a pouch mounted within the container body for storing a fluid composition therein and fluidly coupled with the valved opening for dispensing the contents of the pouch;

a dispensing tube extending from the valved opening to a dispensing outlet, the dispensing tube further comprising an extension that branches from the dispensing tube and a check valve to preclude fluid flow from the dispensing tube into the extension; and a pressurized gas between the pouch and the container body for pressurizing the contents of the pouch for dispensing under pressure through the first fluid dispenser; and a fluid refill system including:

at least one reservoir having a fluid composition therein;

a second fluid dispenser connected to the at least one reservoir and having a fitting that is adapted to interface with the valved opening of the first fluid dispenser to dispense the fluid composition under pressure into the pouch; and a controller that is programmed to respond to input signals to position the container body into a docking relationship with the fluid refill system, wherein the second fluid dispenser fitting interfaces with the first fluid dispenser, and to dispense the fluid composition under pressure into the pouch;

wherein the extension includes a fitting adapted to interface with the second fluid dispenser fitting for filling the pouch.

2. The sustainable system of claim 1 wherein a space between the container body and the pouch is provided with at least one of a neutralizing additive and a deactivating additive.

3. The sustainable system of claim 2 wherein the neutralizing additive is metasilicate pentahydrate.

4. The sustainable system of claim 2 wherein the deactivating additive is adapted to deactivate at least one of an enzyme and an oxidizing agent.

5. The sustainable system of claim 1 wherein the first fluid dispenser includes a valve body that forms the valved opening and the pouch is sealed on the valve body.

6. The sustainable system of claim 5 wherein the valve body has a plurality of raised features to increase the surface area of a sealing surface between the valve body and the pouch.

7. The sustainable system of claim 5 further comprising a support between the container body and the pouch to support at least a portion of the weight of the pouch within the container body.

8. The sustainable system of claim 7 wherein the support comprises one of a clip, a clamp, a hook, a netting, a pedestal, a piston and combinations thereof.

9. A sustainable system for refilling a pressurized fluid dispenser comprising:

a container body having a first fluid dispenser that includes a valved opening having a normally closed valve;

a pouch mounted within the container body for storing a fluid composition therein and fluidly coupled with the valved opening for dispensing the contents of the pouch;

a dispensing tube extending from the valved opening to a dispensing outlet, the dispensing tube further comprising an extension that branches from the dispensing tube and a bistable flap that is moveable between a first position in which the flap blocks a flow of fluid through the extension and a second position in which the flap blocks a flow of fluid to the dispensing outlet; and a pressurized gas between the pouch and the container body for pressurizing the contents of the pouch for dispensing under pressure through the first fluid dispenser; and a fluid refill system including:

at least one reservoir having a fluid composition therein;

a second fluid dispenser connected to the at least one reservoir and having a fitting that is adapted to interface with the valved opening of the first fluid dispenser to dispense the fluid composition under pressure into the pouch; and a controller that is programmed to respond to input signals to position the container body into a docking relationship with the fluid refill system, wherein the second fluid dispenser fitting interfaces with the first fluid dispenser, and to dispense the fluid composition under pressure into the pouch;

wherein the extension includes a fitting adapted to interface with the second fluid dispenser fitting for filling the pouch.

10. The sustainable system of claim 9 wherein a space between the container body and the pouch is provided with at least one of a neutralizing additive and a deactivating additive.

11. The sustainable system of claim 10 wherein the neutralizing additive is metasilicate pentahydrate.

12. The sustainable system of claim 10 wherein the deactivating additive is adapted to deactivate at least one of an enzyme and an oxidizing agent.

13. The sustainable system of claim 9 wherein the first fluid dispenser includes a valve body that forms the valved opening and the pouch is sealed on the valve body.

14. The sustainable system of claim 13 wherein the valve body has a plurality of raised features to increase a surface area of a sealing surface between the valve body and the pouch.

15. The sustainable system of claim 13 further comprising a support between the container body and the pouch to support at least a portion of a weight of the pouch within the container body.

16. The sustainable system of claim 15 wherein the support comprises one of a clip, a clamp, a hook, a netting, a pedestal, a piston or combinations thereof.

17. A sustainable system for refilling a pressurized fluid dispenser comprising:

a container body having a first fluid dispenser that includes a valved opening having a normally closed valve;

a pouch mounted within the container body for storing a fluid composition therein and fluidly coupled with the valved opening for dispensing the contents of the pouch;

a dispensing tube extending from the valved opening to a dispensing outlet; and a pressurized gas between the pouch and the container body for pressurizing the contents of the pouch for dispensing under pressure through the first fluid dispenser; and a fluid refill system including:

at least one reservoir having a fluid composition therein;

a second fluid dispenser connected to the at least one reservoir and having a fitting that is adapted to interface with the valved opening of the first fluid dispenser to dispense the fluid composition under pressure into the pouch; and a controller that is programmed to respond to input signals to position the container body into a docking relationship with the fluid refill system, wherein the second fluid dispenser fitting interfaces with the first fluid dispenser, and to dispense the fluid composition under pressure into the pouch;

wherein the first fluid dispenser further includes a selectively rotatable cap that is rotatable between a first position in which the dispensing outlet is accessible and a second position in which a filling inlet is accessible and wherein when the cap is in the first position the fluid composition can be selectively dispensed from the pouch through the dispensing outlet onto a surface to be cleaned and when the cap is in the second position the pouch can be refilled through the filling inlet by the refill system.

18. The sustainable system of claim 17 wherein a space between the container body and the pouch is provided with at least one of a neutralizing additive and a deactivating additive.

19. The sustainable system of claim 18 wherein the neutralizing additive is metasilicate pentahydrate.

20. The sustainable system of claim 18 wherein the deactivating additive is adapted to deactivate at least one of an enzyme and an oxidizing agent.

21. The sustainable system of claim 17 wherein the first fluid dispenser includes a valve body that forms the valved opening and the pouch is sealed on the valve body.

22. The sustainable system of claim 21 wherein the valve body has a plurality of raised features to increase a surface area of a sealing surface between the valve body and the pouch.

23. The sustainable system of claim 21 further comprising a support between the container body and the pouch to support at least a portion of a weight of the pouch within the container body.

24. The sustainable system of claim 23 wherein the support comprises one of a clip, a clamp, a hook, a netting, a pedestal, a piston or combinations thereof.

* * * * *